US008270657B2

(12) United States Patent
Takigawa et al.

(10) Patent No.: US 8,270,657 B2
(45) Date of Patent: Sep. 18, 2012

(54) EARPHONE DEVICE AND SOUND GENERATING APPARATUS EQUIPPED WITH THE SAME

(75) Inventors: Souichi Takigawa, Hamamatsu (JP); Yoshikatsu Matsubara, Hamamatsu (JP); Masayoshi Yamashita, Hamamatsu (JP); Nobushiro Aiba, Hamamatsu (JP); Tsuneyasu Demukai, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 364 days.

(21) Appl. No.: 12/644,096

(22) Filed: Dec. 22, 2009

(65) Prior Publication Data

US 2010/0166245 A1 Jul. 1, 2010

(30) Foreign Application Priority Data

Dec. 26, 2008 (JP) ..... 2008-333746

(51) Int. Cl.
*H04R 25/00* (2006.01)

(52) U.S. Cl. ..... 381/380; 381/372; 381/373

(58) Field of Classification Search ..... 381/309, 381/71.6, 72, 328, 370, 371, 372, 373, 380, 381/382; 181/129, 130, 135; 379/430, 431; 128/864, 867, 868

See application file for complete search history.

(56) References Cited

U.S. PATENT DOCUMENTS

| | | | | |
|---|---|---|---|---|
| 6,082,485 | A | 7/2000 | Smith | |
| 7,391,878 | B2 * | 6/2008 | Liao | 381/370 |
| 2005/0105755 | A1 * | 5/2005 | Yueh | 381/371 |
| 2007/0177753 | A1 * | 8/2007 | Weinans et al. | 381/373 |

FOREIGN PATENT DOCUMENTS

| | | | |
|---|---|---|---|
| CN | 101874410 | A | 10/2010 |
| EP | 1058479 | A2 | 12/2000 |
| JP | 3-117995 | A | 12/1991 |
| JP | 3114580 | A | 8/2005 |
| WO | WO-99-55262 | A1 | 11/1999 |
| WO | WO-2007-018657 | A2 | 2/2007 |

* cited by examiner

*Primary Examiner* — Huyen D Le
(74) *Attorney, Agent, or Firm* — Dickstein Shapiro LLP

(57) ABSTRACT

An inserting type earphone device is broken down into a signal-to-sound converter, an ear pad to be inserted into an acoustic meatus of user, a sound tube provided between the signal-to-sound converter and the ear pad and a switching mechanism provided in association with the sound tube and ear pad, and a sound hole, which is formed in the sound tube for connecting a sound propagation hole to the outside, is open to and closed with the switching mechanism; the switching mechanism makes the sound hole open and closed through rotation thereof around the sound tube so that the ear pad is not inclined in the acoustic meatus during the rotation, whereby the ear pad is not dropped off from the acoustic meatus.

20 Claims, 9 Drawing Sheets

EARPHONE DEVICE AND SOUND GENERATING APPARATUS EQUIPPED WITH THE SAME

FIELD OF THE INVENTION

This invention relates to an earphone device and, more particularly, to an earphone device capable of changing a sound passage between closed state and open state and a sound generating apparatus equipped with the earphone.

DESCRIPTION OF THE RELATED ART

Various types of the earphone devices are offered to users in the market. Ear-hung type earphone devices have respective hooks. The user hangs the hook on his or her auricle, and the hook keeps the signal-to-sound converter, i.e., a small loud speaker unit lightly touching the entrance of acoustic meatus. The ear-hung type earphone does not forcibly expand the acoustic meatus of user. For this reason, the user does not feel the ear-hung type earphone device discomfort.

Intra-concha type earphone devices have respective inserting bodies respectively formed with sound propagation paths, and the signal-to-sound converters are secured to outer ends of the inserting bodies. A user inserts the inserting body into the acoustic meatus. The inserting body slightly expands the skin defining the acoustic meatus so that the inserting body and signal-to-sound converter is maintained by virtue of the friction between the skin and the outer surface of the inserting body. The acoustic meatus is closed with the inserting body. The intra-concha type earphone device is smaller than the ear-hung type earphone. However, the user feels the inserting body inside the acoustic meatus stuffy and discomfort. Moreover, it is hard for the outside sound to penetrate into the acoustic meatus.

A typical example of the ear-hung type earphone device is disclosed in the specification of Japan Utility Model Registration No. 3114580. The prior art ear-hung type earphone device has a housing, which forms a unitary structure together with a hook, and a loud speaker unit is provided inside the housing. The housing is so large that the entrance of user's acoustic meatus is closed with the housing. The housing is formed with a hole, and the hole is open to both of the inner space of housing and the environment. A seesaw switch is provided on the housing, and a user presses the seesaw switch for changing the hole between the open state and the closed state. While the seesaw switch is keeping the hole closed, the sound, which is generated through the loud speaker unit, is sealed in the inner space, and the user feels the sound to be emphasized in higher register. On the other hand, when the user oppositely pushes the seesaw switch, the hole is open, and the hole permits the sound to be radiated from the inner space to the environment. In this situation, the user feels the sound to be emphasized in the lower register. Thus, the prior art ear-hung type earphone device is capable of changing the tone quality of sound generated therein.

Although the seesaw switch is large, the housing of the ear-hung type earphone device is wide enough to permit the manufacturer to provide the seesaw switch on the housing. However, it is difficult to attach the seesaw switch to a housing of the intra-concha type earphone device such as a canal type earphone device.

A prior art intra-concha type earphone device is disclosed in Japan Utility Model Application laid-open No. Hei 3-117995. The prior art intra-concha type earphone device has an inverted L-letter shaped housing, and a loud speaker unit is provided in the inner space of the housing. The inverted L-letter shaped housing has an inserting portion, and the user inserts the inserting portion into his or her acoustic meatus. Sound is generated through the loud speaker unit, and is radiated from the inner space through small holes, which are formed in the end surface of the inserting portion, into the acoustic meatus. A sound hole is further formed in the back surface, which is opposite to the end surface, and an excluding plate is provided on the back surface. The excluding plate is slidable on the back surface, and is changed between open position and a closing position. In order to slide the excluding plate, a small knob is formed in the excluding plate. While the sound propagation hole is being open, the diaphragm of loud speaker unit is exposed through the sound propagation hole to the outside. On the other hand, when the sound propagation hole is closed with the excluding plate, the excluding plate does not permit the inside sound to be conducted to the outside. Moreover, when the user wishes to hear the outside sound without taking off the earphone device, he or she pulls down the knob, and makes the outside sound penetrate into the acoustic meatus through the sound propagation hole.

A problem is encountered in the prior art intra-concha type earphone device in that the intra-concha earphone device is liable to be dropped off from the acoustic meatus. In detail, when the user inserts the inserting portion into the acoustic meatus, the back surface extends in a vertical direction, i.e., a direction parallel to the direction in which the gravity exerts on the earphone device, and the excluding plate is movable in the vertical direction. In this situation, the user pinches the knob with his or her fingers, and pulls down the knob so as to change the sound propagation hole to the open state. Moment exerts on the housing, and makes the inserting portion of prior art intra-concha type earphone device pulled out from the acoustic meatus. Thus, the prior art intra-concha type earphone device is unstable in the change between the open state and the closed state. Other earphone devices are categorized in an inserting type earphone device, and the problem of prior art intra-concha type earphone devices is expected to be encountered in the inserting type earphone devices.

SUMMARY OF THE INVENTION

It is therefore an important object of the present invention to provide an earphone device, which is stable in an acoustic meatus in change between open state and closed state of a sound hole.

It is also an important object of the present invention to provide a sound generating apparatus, which includes the earphone device.

To accomplish the object, the present invention proposes to change a switching mechanism between open state and closing state through movements in a direction parallel to a centerline of a sound propagation body or rotation about the centerline.

In accordance with one aspect of the present invention, there is provided an earphone device for radiating sound into an acoustic meatus of a user comprising a signal-to-sound converter supplied with an audio signal and converting the audio signal to inside sound, a sound propagation body connected to the signal-to-sound converter, having an inserting portion to be inserted into the acoustic meatus and formed with a sound propagation hole defined therein for propagating the inside sound from the signal-to-sound converter to the acoustic meatus and a sound hole open at one end thereof to an environment and a switching mechanism supported by the sound propagation body and changed between open state where the other end portion of the sound hole is connected to the sound propagation hole and closing state where the sound hole is closed therewith through movements thereof in a direction parallel to a centerline of the sound propagation hole or rotation about the centerline.

In accordance with another aspect of the present invention, there is provided a sound generating apparatus for supplying sound to a user comprising a source of inside sound producing an audio signal representative of inside sound, and an earphone device radiating the sound into an acoustic meatus of a user and including a signal-to-sound converter supplied with the audio signal and converting the audio signal to the inside sound, a sound propagation body connected to the signal-to-sound converter, having an inserting portion to be inserted into the acoustic meatus and formed with a sound propagation hole defined therein for propagating the inside sound from the signal-to-sound converter to the acoustic meatus and a sound hole open at one end thereof to an environment and a switching mechanism supported by the sound propagation body and changed between open state where the other end portion of the sound hole is connected to the sound propagation hole and closing state where the sound hole is closed therewith through movements thereof in a direction parallel to a centerline of the sound propagation hole or rotation about the centerline.

BRIEF DESCRIPTION OF THE DRAWINGS

The features and advantages of the earphone device and sound generating apparatus will be more clearly understood from the following description taken in conjunction with the accompanying drawings, in which.

DESCRIPTION OF THE PREFERRED EMBODIMENTS

Figure 1:
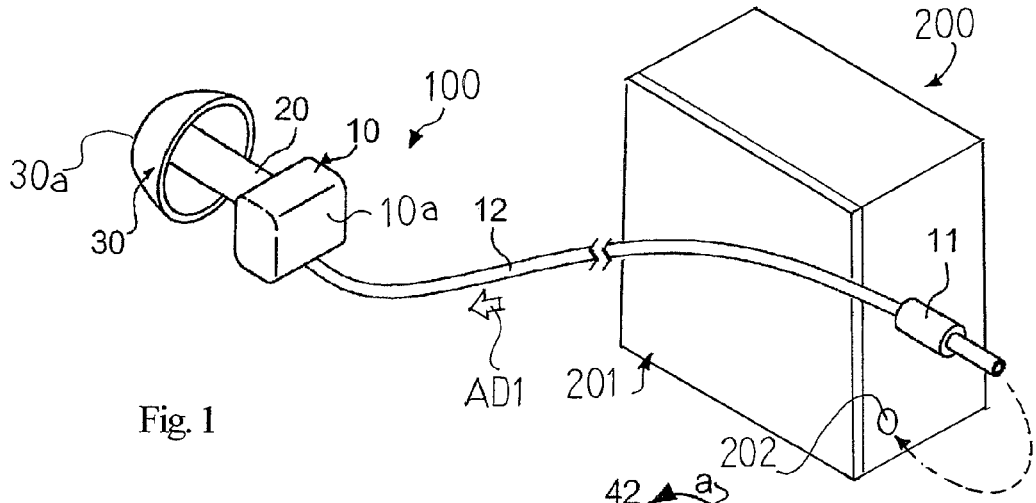
FIG. 1 is a perspective view showing a sound generating apparatus equipped with an inserting type earphone device of the present invention.

In the following description, term "inserting type earphone device" means an earphone device, which has a portion to be inserted into an acoustic meatus of a user. Earphone devices embodying the present invention are categorized in the inserting type earphone device.

Term "front" is indicative of a position closer to the acoustic meatus of a user than a position modified with term "rear".

A sound generating apparatus of the present invention largely comprises a source of sound and an earphone device, and the earphone device is connected to the source of sound.

An audio signal is generated in the source of sound, and is representative of inside sound. The audio signal may be generated from pieces of audio data stored in an information storage medium such as, for example, a compact disk or converted from radio wave broadcasted from a radio station. The audio signal is supplied from the source of sound to the earphone device, and sound is radiated into an acoustic meatus of a user.

The earphone device includes a signal-to-sound converter, a sound propagation body and a switching mechanism. The sound propagation body is connected to the signal-to-sound converter, and the switching mechanism is supported by the sound propagation body.

The signal-to-sound converter is supplied with the audio signal, and converts the audio signal to the inside sound. The sound propagation body has an inserting portion, which is to be inserted into the acoustic meatus of user. The sound propagation body is formed with a sound propagation hole and a sound hole. The sound propagation hole is defined in the sound propagation body, and the inside sound is propagated from the signal-to-sound converter to the acoustic meatus through the sound propagation hole.

The sound hole is open at one end thereof to an environment, and the other end of sound hole is connected to and disconnected from the sound propagation hole by means of the switching mechanism.

The switching mechanism is changed between open state and closing state. While the switching mechanism is staying at the open state, the other end portion of the sound hole is connected to the sound propagation hole. Part of the inside sound escapes through the sound hole so that the sound-to-signal converter produces the inside sound, lower register of which is emphasized. Moreover, outside sound penetrates from the environment into the sound propagation hole so that the user hears the outside sound.

On the other hand, when the switching mechanism is changed to the closing state, the sound hole is closed, and the outside sound does not enter the sound propagation hole. Moreover, the signal-to-sound converter is restricted in vibrations so that higher register of the inside sound is emphasized.

The switching mechanism is changed between the open state and the closing state through movements thereof in a direction parallel to a centerline of the sound propagation path or rotation about the centerline. While the switching mechanism is being changed, any force to make the inserting portion inclined in the acoustic meatus is not exerted on the inserting portion. For this reason, the inserting portion is stable in the acoustic meatus, and is not dropped off from the acoustic meatus.

First Embodiment

Figure 2A:
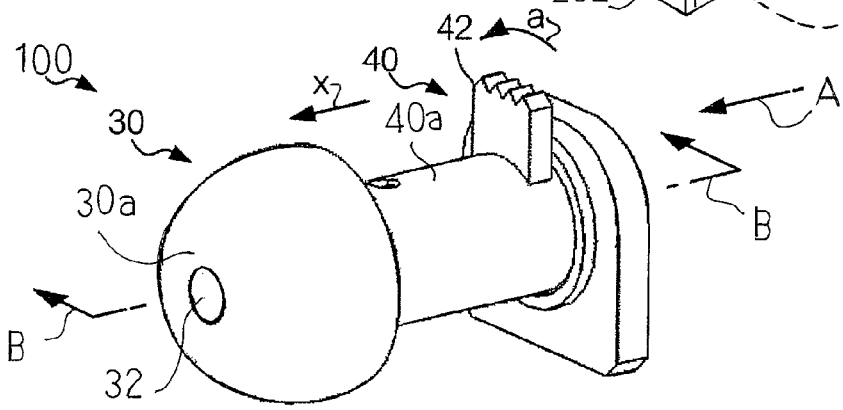
FIG. 2A is a perspective view showing a sound tube, an ear pad and a switching mechanism of the inserting type earphone device.
Figure 2B:
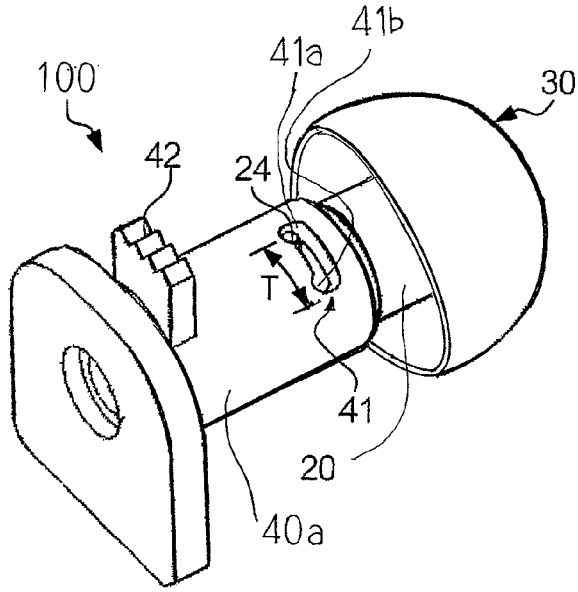
FIG. 2B is a perspective view showing the sound tube, ear pad and switching mechanism seen in a direction of arrow A of FIG. 2A.

Referring first to FIGS. 1, 2A and 2B of the drawings, a sound generating apparatus 200 largely comprises an inserting type earphone device 100 and a compact disk player 201. The compact disk player 201 is well known to persons skilled in the art, and no further description is hereinafter incorporated for the sake of simplicity.

The inserting type earphone device 100 comprises a signal-to-sound converter 10, a jack 11, a lead cable 12, a sound tube 20, an ear pad 30 and a switching mechanism 40. The jack 11 is inserted into a socket 202, and an audio signal AD1 is supplied from the compact disk player 201 through the socket 202 to the jack 11 in playback on a compact disk. The lead cable 12 is flexible, and is connected between the jack 11 and the signal-to-sound converter 10. The audio signal AD1 is propagated through the lead cable 12 to the signal-to-sound converter 10.

The signal-to-sound converter 10 includes a casing 10*a*, a coil unit (not shown) and a diaphragm (not shown), and the coil unit and diaphragm are housed in the casing 10*a*. While the audio signal AD1 is flowing through the coil unit, the coil unit gives rise to vibrations of the diaphragm so as to generate inside sound.

The sound tube 20 is connected at one end thereof to the signal-to-sound converter 10 and at the other end thereof to the ear pad 30. The sound tube 20 is made of synthetic resin, and has a cylindrical configuration. The inside sound enters into the sound tube 20, and is propagated to the ear pad 30 through the sound tube 20.

The ear pad 30 is made of silicone rubber, and is flared over the sound tube 20 like a mushroom. The sound tube 20 and ear pad 30 form a unitary structure, and the sound tube 20 is open to a font end surface 30*a* of the ear pad 30. Although the front end surface 30*a* is less in diameter than the acoustic meatus, the flared end of ear pad is slightly greater in diameter than the acoustic meatus. When the user pushes the ear pad 30 into the acoustic meatus, the ear pad 30 is deformed. The deformed ear pad 30 proceeds deep into the acoustic meatus, and is tightly held in contact with the skin defining the acoustic meatus. For this reason, any sound passage does not take place between the skin and the ear pad 30. The ear pad 30 is inserted into the acoustic meatus more deeply than the intra-concha type earphone device is.

The ear pad 30 is formed with a sound hole 32, and is open to the front end surface 30*a*. The sound tube 20 is open to the outside through the sound hole 32. The inside sound is radiated through the sound hole 32 into the acoustic meatus.

The switching mechanism 40 is provided in association with the sound tube 20, and the user changes the switching mechanism 40 between open sate and closing state though movement in the direction in parallel of the circumference of the sound tube 20. While the user is keeping the switching mechanism 40 in the closing state, the inside sound is confined in the sound tube 20, and the user feels the inside sound to be emphasized in higher register. On the other hand, when the user changes the switching mechanism 40 to the open state, the switching mechanism 40 permits the inside sound to be radiated to the outside the sound tube 20, and the user feels the inside sound to be emphasized in lower register. Thus, the quality of inside sound is changed through the movement of switching mechanism 40. Moreover, when the user wishes to hear the outside sound such as voice of another person, he or she changes or keeps the switching mechanism 40 in the open state, and permits the outside sound to penetrate into the acoustic meatus through the sound tube 20. Thus, the user can hear the outside sound without removal of the earphone device 100 from the acoustic meatus.

As will be understood from the foregoing description, when the user wishes to change the quality of inside sound, he or she gives rise to the movement of switching mechanism 40 in the direction parallel to the circumference of sound tube 20. The movement of switching mechanism 40 does not make the ear pad 30 and sound tube 20 inclined inside the acoustic meatus. Even if the user gives rise to the rotation of sound tube 20 in the change of switching mechanism 40, the rotation of sound tube 30 and ear pad 30 is not causative of being dropped off from the acoustic meatus.

Figure 3:
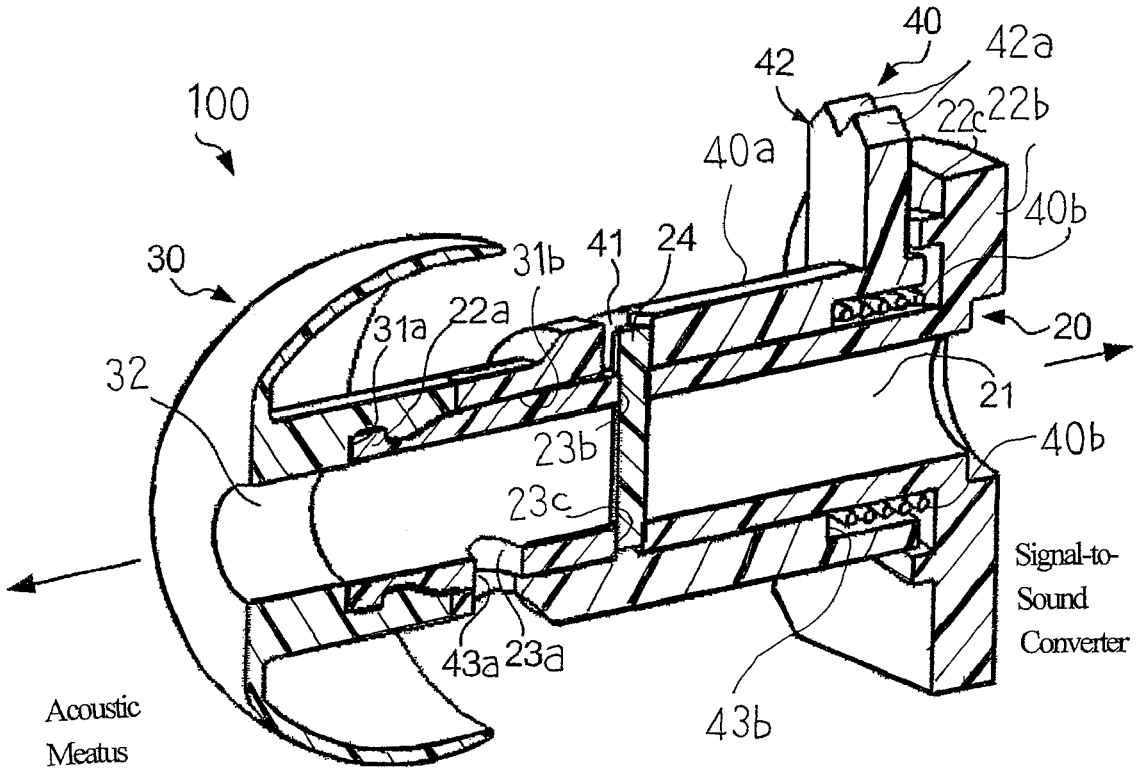
FIG. 3 is a partially cut-away perspective view taken along line B-B of FIG. 2A and showing the sound tube, ear pad and switching mechanism.

As will be better seen in FIG. 3, the sound tube 20 is formed with a front flange 22 and a rear flange, and a sound propagation hole 21 is defined in the sound tube 20 between the front flange 22*a* and the rear flange 22*b*. The sound propagation hole 21 extends in a direction parallel to arrow "x", and the inner diameter of sound propagation hole 21 is approximately equal to the inner diameter of sound hole 32. The rear flange 22*b* is held in contact with the housing 10*a* of signal-to-sound converter 10, and the diaphragm is exposed to the sound propagation hole 21.

The ear pad 30 is formed with a ring-shaped groove 31*a*, and the ring-shaped groove 31*a* is exposed to the sound hole 32. The depth of ring-shaped groove 31*a* is approximately equal to the height of front flange 22*a*, and the ring-shaped groove 31*a* is connected to the rear end surface of ear pad 30 through a diffused inner space 31*b*. The front flange 31*a* is less in diameter than the diffused inner space 31*b* at the rear end surface. While the user is inserting the front flange 31*a* into the diffused inner space 31*b*, the front flange 31*a* is inwardly deformed. When the front flange 31*a* reaches the ring-shaped groove 31*a*, the front flange 22*a* is recovered to the original configuration, and is received in the ring-shaped groove 31*a*. Thus, the sound tube 20 and ear pad 30 form the unitary structure by means of the front flange 22*a* and ring-shaped groove 31*a*. The sound propagation hole 21 is connected to the sound hole 32. The inside sound is propagated from the diaphragm through the sound propagation hole 21 to the sound hole 32, and is radiated from the sound hole 32 to the outside of the ear pad 30.

The sound tube 20 is further formed with a circular hole 23 and a pair of small circular holes 23*b*/23*c*. The circular hole 23 is spaced from the front flange 22*a* so as to be not overlapped with the ear pad 30. Thus, the circular hole 23 is open at the inner end thereof to the sound propagation hole 21 and at the outer end thereof to the outer surface of the sound tube 20.

The small circular holes 23*b* and 23*c* are spaced from each other by 180 degrees, and have respective centerlines aligned with one another. The pair of small circular holes 23*b*/23*c* is spaced from the front flange 22*a* wider than the circular hole 23*a*, and are open at the inner ends thereof to the sound propagation hole 21 and at the outer ends thereof to the outer surface of sound tube 20.

The switching mechanism 40 includes a stopper pin 24, a short tube 40*a*, a coil spring 40*b* and a knob 42. The short tube 40*a* and knob 42 are made of synthetic resin. The stopper pin 24 is snugly received in the pair of small circular holes 23*b* and 23*c* so that outside tone does not penetrate into the sound propagation hole 21 through the circular hole 23*b*. Although the one end portion of the stopper pin 24 remains in the small circular hole 23*c*, the other end portion of stopper pin 24 projects from the small circular hole 23*b*.

The inner diameter of the short tube 40*a* is slightly wider than the outer diameter of sound tube 20, and the sound tube 20 is inserted into the short tube 40*a*. The short tube 40*a* is rotatable about the sound tube 20 in a direction indicated by arrow a in FIG. 2A and the opposite direction. The short tube 40*a* is formed with a long hole 41 and a circular hole 43*a*. The circular hole 43*a* is close to the front end surface of the sound tube 20, and is equal in diameter to the circular hole 23*a*. While the circular hole 43*a* is being offset from the circular hole 23*a*, the circular hole 23*a* is closed with the short tube 40*a*. When the circular hole 23*a* is overlapped with the circular hole 43*a* through the rotation about the sound tube 20, the sound propagation hole 21 is open to the outside through the circular holes 23*a* and 43*a*.

The long hole 41 extends over distance T as shown in FIG. 2B, and the distance T is longer than the diameter of stopper pin 24. The long hole 41 is widened at both end portions 41*a* and 41*b* thereof, and the wide end portions 41*a* and 41*b* are rounded. The stopper pin 24 projects into the long hole 41, and permits the short tube 40*a* to rotate over the distance T. However, when the stopper pin 24 is brought into contact with either rounded wide end portion 41*a* or 41*b*, the stopper pin 24 prohibits the short tube 40*a* from further rotation. In order to guide the short tube 40*a* in the relative rotation about the sound tube 20, a guide ring 22*c* is formed on the front surface of rear flange 22*b* so as to restrict the short tube 40*a* in rotation.

The knob 42 forms a unitary structure together with the short tube 40*a*, and projects from the outer surface of short tube 40*a*. The knob 42 is higher than the rear flange 22*b* so that a rough to surface 42*a* of the knob 42 projects over the outer surface of rear flange 22*b*.

The rear end portion of short tube 40*a* is made wider in diameter than the remaining portion. When the sound tube 20 is inserted into the short tube 40*a*, a pocket 43*b* takes place between the inner surface of rear end portion and the outer surface of sound tube 20, and the coil spring 40*b* is received in the pocket 43*b*. The coil spring 40*b* is compressed between the front surface of rear flange 22*b* and the bottom surface defining the pocket 43*b*. The coil spring 40*b* urges the short tube 40*a* toward the ear pad 30, i.e., in a direction x shown in FIG. 2A. As hereinbefore described, the long hole 41 has rounded wide end portions 41*a* and 41*b*. When the stopper pin 24 reaches either rounded wide end portion 41*a* or 41*b* after the rotation about the sound tube 20 in a certain direction, the coil spring 40*b* causes the stopper pin 24 to get into the rounded wide end portion 41*a*, and the stopper pin 24 is captured in the rounded wide end portion 41*a* or 41*b* in stable. When the user wishes to rotate the short tube 40*a* in the opposite direction, he or she strongly pushes the knob 42 in the opposite direction. Then, the stopper pin 24 gets out of the rounded wide end portion 41*a* or 41*b* against the elastic force of the coil spring 40*b*, and permits the short tube 40*a* to rotate in the opposite direction. In this instance, when the stopper pin 24 is captured in the rounded wide end portion 41*b*, the switching mechanism 40 enters the open state, and the circular hole 23*a* is aligned with the circular hole 43*a*. On the other hand, when the stopper pin 24 is captured in the other rounded wide end portion 41*a*, the switching mechanism 40 is changed to the closing state, and the circular hole 23*a* is closed with the short tube 40*a*.

Description is hereinafter made on behavior of switching mechanism 40 with reference to FIGS. 4A, 4B, 5A and 5B. The stopper pin 24 and coil spring 40*b* are deleted from FIGS. 4A and 5A for the sake of simplicity.

Figure 4A:
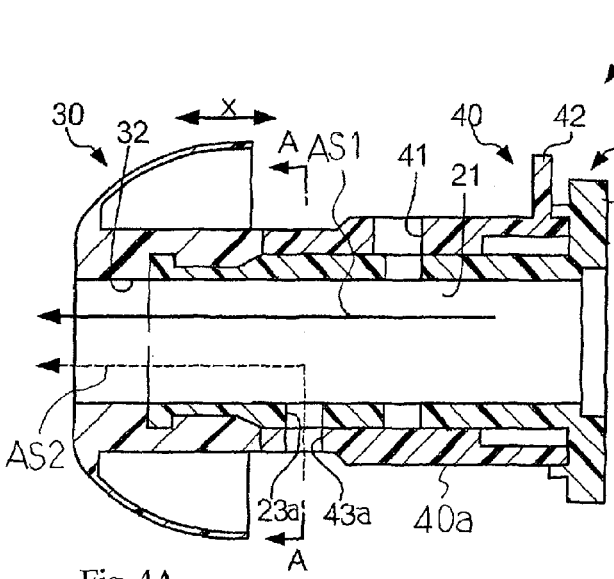
FIG. 4A is a cross sectional view showing the switching mechanism in open state.
Figure 4B:
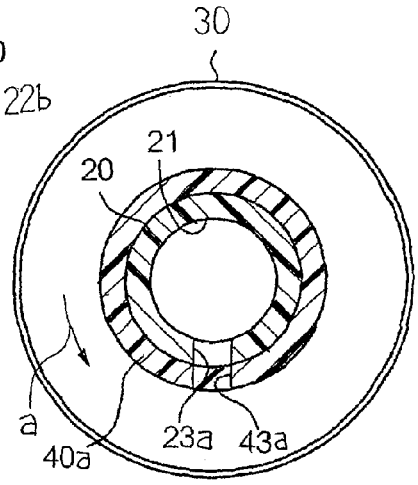
FIG. 4B is a cross sectional view taken along line A-A of FIG. 4A and showing a relative position between a sound tube and a short tube in the open state.

When the user wishes to emphasize the lower register, or when the user wishes to hear the outside sound, he or she pushes the knob 42 in the direction indicated by arrow a, the knob 42 and short tube 40*a* are rotated in the direction indicated by arrow a. The rounded wide end portion 41*a* reaches the stopper pin 24, and the stopper pin 24 gets into the rounded wide end portion 41*b*. In this situation, the circular hole 43*a* is aligned with the circular hole 23*a*, and the sound propagation hole 21 is connected to the outside through the circular holes 23*a* and 43*a* as shown in FIGS. 4A and 4B. In this situation, the diaphragm of signal-to-sound converter 10 becomes well vibrating, and the lower register of inside sound is emphasized. The inside sound is propagated through the sound propagation hole 21 as indicated by arrow AS1, and is radiated through the sound hole 32 into the acoustic meatus of user.

The outside sound passes through the circular holes 43*a* and 23*a* into the sound propagation hole 21 as indicated by arrow AS2, and is also radiated through the sound hole 32 into the acoustic meatus of user. In case where the user wishes to hear the voice of another person, the user may turn off the CD player 201, and makes only the outside sound reach the acoustic meatus.

Figure 5A:
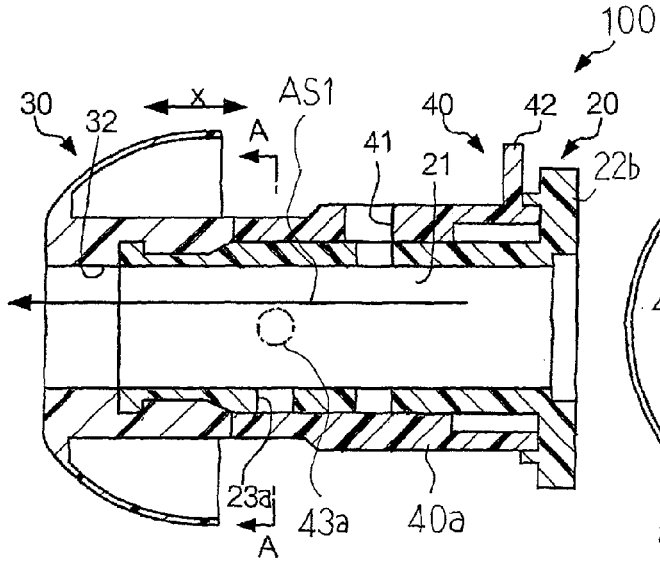
FIG. 5A is a cross sectional view showing the switching mechanism in closing state.
Figure 5B:
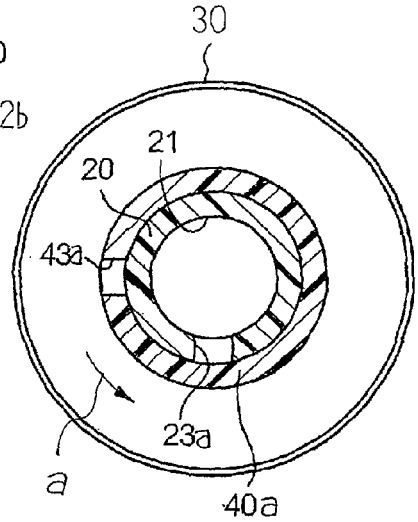
FIG. 5B is a cross sectional view taken along line A-A of FIG. 5A and showing a relative position between a sound tube and a short tube in the closing state.

On the other hand, when the user wishes to emphasize the higher register of inside sound, he or she pushes the knob 42 in a direction opposite to the arrow a. The knob 42 and short tube 40*a* are rotated in the direction opposite to the arrow a, and the other rounded wide end portion 41*a* reaches the stopper pin 24. Then, the switching mechanism 40 is changed to the closing state, and the circular hole 23*a* is closed with the short tube 40*a* as shown in FIGS. 5A and 5B.

In this situation, the inside sound is confined in the sound propagation hole 21 and acoustic meatus, and the vibrations of diaphragm are restricted. For this reason, the higher register of inside sound is emphasized. The sound propagation hole 21 is blocked from the outside sound. Only the inside sound is propagated through the sound propagation hole 21 as indicated by the arrow AS1, and is radiated through the sound hole 32 into the acoustic meatus.

As will be understood from the foregoing description, the switching mechanism 40 is changed between the open state and the closing state through the rotation about the sound tube 20. While the user is exerting the force on the knob 42, the exerted force gives rise to the rotation of the knob 42 and short tube 40*a*. Although the friction between the sound tube 20 and the short tube 40*a* may cause the ear pad 30 to rotate inside the acoustic meatus, the friction between the ear pad 30 and the skin is much larger than the friction between the sound tube 20 and the short tube 40*a*, and the ear pad 30 is hardly rotated. Even if the user further exerts the force on the knob 42 after the contact between the stopper pin 24 and the rounded wide end portion 41*a* or 41*b*, the ear pad 30 merely rotates inside the acoustic meatus, and any component force to pull out the ear pad 30 is not exerted on the ear pad 30. For this reason, the ear pad 30 is not dropped off from the acoustic meatus.

Second Embodiment

Turning to FIGS. 6A, 6B, 7A and 7B of the drawings, another inserting type earphone device 100A embodying the present invention largely comprises a signal-to-sound converter 10A, a sound tube 20A, an ear pad 30A and a switching mechanism 40A. The signal-to-sound converter 10A and ear pad 30A are similar in structure and material to the signal-to-sound converter 10 and ear pad 30. For this reason, description on the signal-to-sound converter 10A and ear pad 30A is omitted for the sake of simplicity.

The sound tube 20A is different from the sound tube 20 in that the circular holes 23*b* and 23*c* are not formed in the sound tube 20A. The other portions and holes of sound tube 20A are same as those of the sound tube 20, and are labeled with references designating the corresponding portions and hole of the sound tube 20 without detailed description.

The switching mechanism 40A includes a short tube 40Aa and a knob 42A. The stopper pin 24 and coil spring 40*b* are not incorporated in the switching mechanism 40A. The short tube 40Aa is similar to the short tube 40*a* except for the circular hole 43*a* and long hole 41. Although the circular hole 43*a* and long hole 41 are formed in the short tube 40*a*, neither circular hole nor long hole is formed in the short tube 40Aa. The length of short tube 40Aa is less than the distance between the circular hole 23*a* and the rear flange 22*b*. The knob 42A projects from the outer surface of the short tube 40Aa as similar to the knob 42.

The sound tube 20A is inserted into the short tube 40Aa. Since any stopper pin is not provided for the short tube 40Aa, the short tube 40Aa is slidable on the outer surface of sound tube 20A in the direction parallel to the arrow x. When the short tube 40Aa is held in contact with the rear flange 22*b*, the circular hole 23*a* is not overlapped with the short tube 40Aa, because the length of short tube 40Aa is less than the distance between the circular hole 23*a* and the rear flange 22*b*. On the other hand, when the short tube 40Aa is held in contact with the ear pad 30A, the circular hole 23*a* is over lapped with the short tube 40Aa, and, accordingly, is closed with the short tube 40Aa.

Figure 6A:
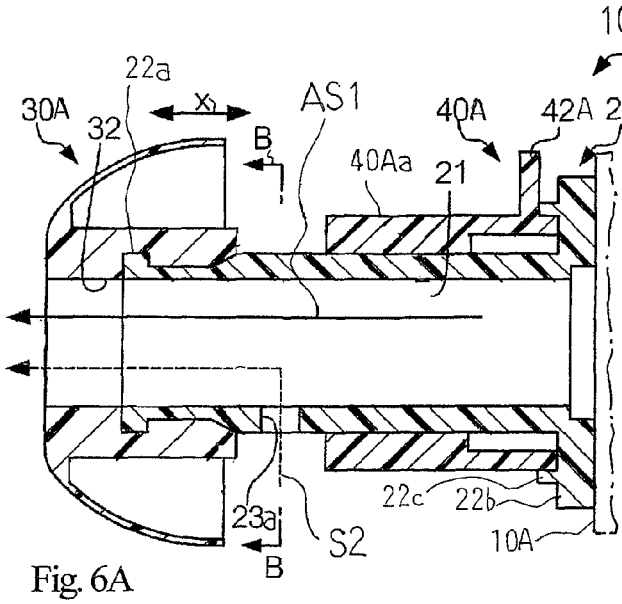
FIG. 6A is a cross sectional view showing another inserting type earphone device of the present invention.
Figure 6B:
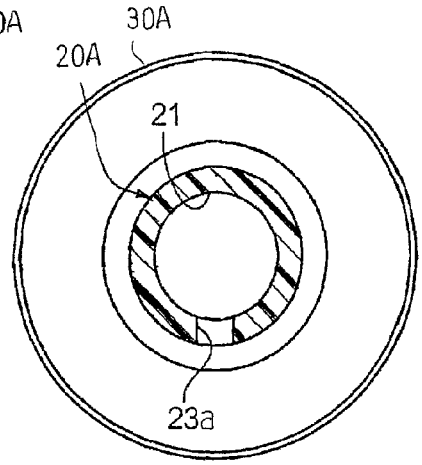
FIG. 6B is a cross sectional view taken along line B-G of FIG. 6A and showing a relative position between a sound tube and a short tube in open state.

Description is hereinafter made on behavior of switching mechanism 40A. When the user wishes to emphasize the lower register, or when the user wishes to hear the outside sound, he or she pushes the knob 42A in the direction toward the rear flange 22*b*. The knob 42A and short tube 40Aa slide on the outer surface of sound tube 20A, and the short tube 40Aa is brought into contact with the front surface of the rear flange 22*b*. Then, the switching mechanism 40A enters the open state. The circular hole 43*a* is evacuated from the position over the circular hole 23*a*, and the sound propagation hole 21 is connected to the outside through the circular hole 23*a* as shown in FIGS. 6A and 6B. In this situation, the diaphragm of signal-to-sound converter 10A becomes well vibrating, and the lower register of inside sound is emphasized. The inside sound is propagated through the sound propagation hole 21 as indicated by arrow AS1, and is radiated through the sound hole 32 into the acoustic meatus of user.

The outside sound passes through the circular hole 23*a* into the sound propagation hole 21 as indicated by arrow AS2, and is also radiated through the sound hole 32 into the acoustic meatus of user. In case where the user wishes to hear the voice of another person, the user may turn off the source of inside sound signal, and makes only the outside sound reach the acoustic meatus.

Figure 7A:
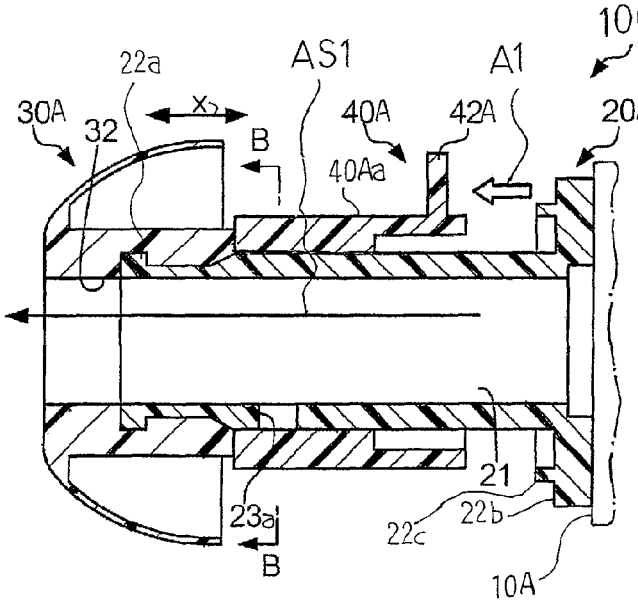
FIG. 7A is a cross sectional view showing the switching mechanism in closing state.
Figure 7B:
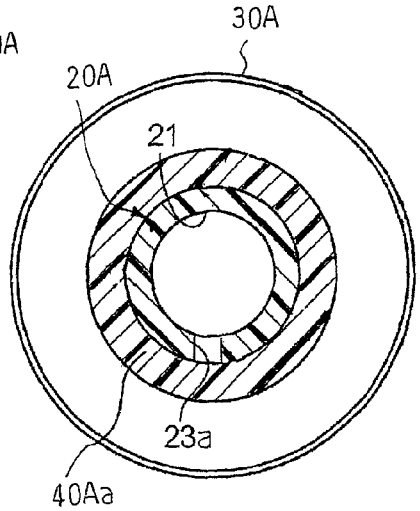
FIG. 7B is a cross sectional view taken along line B-B of FIG. 7A and showing a relative position between a sound tube and a short tube in the closing state.

On the other hand, when the user wishes to emphasize the higher register of inside sound, he or she pushes the knob 42A in a direction toward the ear pad 30A, i.e., a direction indicated by an arrow A1. The knob 42A and short tube 40Aa slide on the outer surface of sound tube 20A in the direction indicated by the arrow A1, and the short tube 40Aa is brought into contact with the ear pad 30A. Then, the switching mechanism 40A is changed to the closing state, and the circular hole 23*a* is closed with the short tube 40Aa as shown in FIGS. 7A and 7B. Even if the short tube 40Aa is rotatable about the sound tube 20A in the movement toward the ear pad 30A, the circular hole 23*a* is surely closed with the short tube 40Aa, because any circular hole is not formed in the short tube 40Aa.

In this situation, the inside sound is confined in the sound propagation hole 21 and acoustic meatus, and the vibrations of diaphragm are restricted. For this reason, the higher register of inside sound is emphasized. The sound propagation hole 21 is blocked from the outside sound. Only the inside sound is propagated through the sound propagation hole 21 as indicated by the arrow AS1, and is radiated through the sound hole 32 into the acoustic meatus.

As will be understood from the foregoing description, the switching mechanism 40 is changed between the open state and the closing state through the sliding movement in the direction parallel to the centerline of sound tube 20A. While the user is exerting the force on the knob 42A, the exerted force gives rise to the sliding of the knob 42A and short tube 40Aa. Although the friction between the sound tube 20A and the short tube 40Aa may cause the ear pad 30 to move in the acoustic meatus, the ear pad 30A is further inserted deeply in the acoustic meatus. For this reason, the ear pad 30A is not dropped off from the acoustic meatus.

Third Embodiment

Figure 8A:
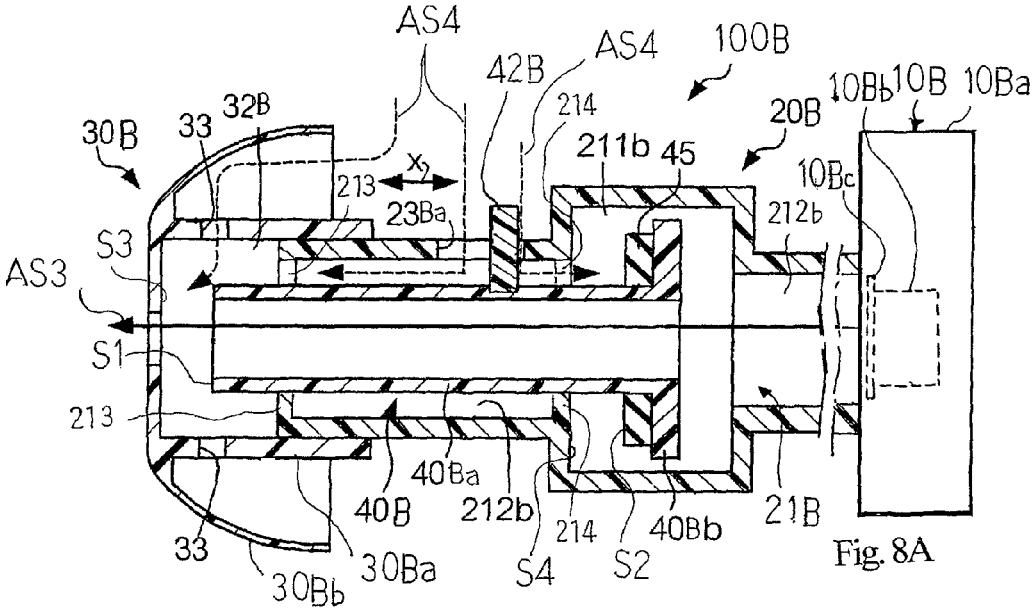
FIG. 8A is a cross sectional view showing yet another inserting type earphone device in the open state.
Figure 8B:
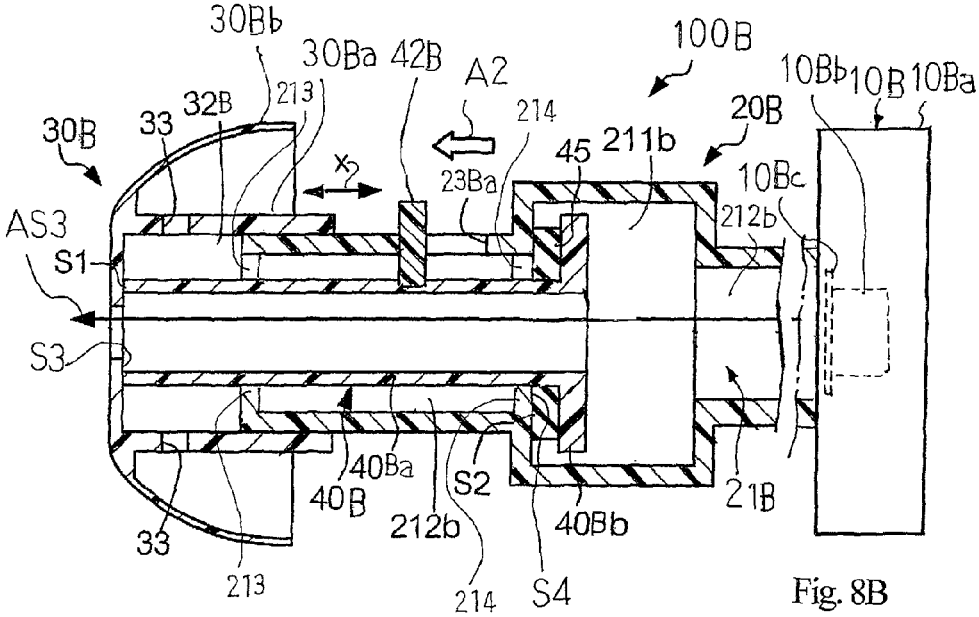
FIG. 8B is a cross sectional view showing a switching mechanism in the closing state.

Turning to FIGS. 8A and 8B of the drawings, yet inserting type another earphone device 100B embodying the present invention largely comprises a signal-to-sound converter 10B, a sound tube 20B, an ear pad 30B and a switching mechanism 40B. In this instance, the switching mechanism 40B is provided inside the sound tube 20B.

The signal-to-sound converter 10B includes a casing 10Ba, a voice coil 10Bb and a diaphragm 10Bc, and the voice coil 10Bb and diaphragm 10Bc is housed in the casing 10Ba. While the audio signal is flowing through the voice coil 10Bb, the diaphragm 10Bc vibrates, and the inside sound is generated.

The sound tube 20B has a tubular configuration. However, the sound tube 20B partially bulges out so that a wide chamber 211*b* takes place between narrow conduits 212*b*. The wide chamber 211*b* and narrow conduits 212*b* as a whole constitute a sound propagation hole 21B. The sound tube 20B is formed with a long hole 23Ba, and the long hole 23Ba extends in a direction parallel to the centerline of the sound propagation hole 21B.

Two sets of small projections 213 and 214 inwardly project from the inner surface of the sound hole 21B into the front narrow conduit 212*b*, and each set has three small projections 213 or 214. The three small projections 213 or 214 of each set are spaced from one another by 120 degrees so that space takes plate between every two of the small projections 213 or 214. The innermost surfaces of small projections 213 and 214 are equally spaced from the centerline of the sound propagation hole 21B.

The ear pad 30B includes a tubular portion 30Ba and a flared portion 30Bb. The tubular portion 30Ba has an inner diameter approximately equal to the outer diameter of the sound tube 20B. The sound tube 20B is inserted into the tubular portion 30Ba, and is snugly received in the tubular portion 30Ba. A sound hole 32B is defined in the tubular portion 30Ba, and is open to the outside of the ear pad 30B. The tubular portion 30Ba is formed with a hole 33, and the hole 33 is open at one end thereof to a space between the inner surface of flared portion 30Bb and the outer surface of tubular portion 30Ba and at the other end thereof to the sound hole 32B.

The switching mechanism 40B includes a short tube 40Ba, a rear flange 40Bb, a knob 42B and a sealing pad 45. The short tube 40Ba and rear flange 40Bb are formed of synthetic resin, and form a unitary structure. The short tube 40Ba has an outer diameter twice as long as the distance between the innermost surface of small projection 213 or 214 and the centerline of the sound propagation hole 21B. For this reason, the short tube 40Ba is slidably supported by the two sets of small projections 213 and 214 in the sound tube 20B.

The flange 40Bb projects from the outer surface of short tube 40Ba, and the sealing pad 45 is adhered to the front surface of the flange 40Bb. The sealing pad 45 is made of rubber. The diameter of rear flange 40Bb is less than the inner diameter of wide chamber 211*b* so that gap takes place between the inner wall defining the wide chamber 211*b* and the circumference of flange 40Bb.

The knob 42B is made of the synthetic resin, and is adhered to the outer surface of short tube 40Ba in such a manner as to project through the long hole 23Ba into the outside of sound tube 20B. The knob 42B is movable together with the short tube 40Ba in the direction indicated by arrow x in FIGS. 8A and 8B. When the knob 42B is held in contact with the rear end surface defining the long hole 23Ba as shown in FIG. 8A, the distance between the knob 45B and the front end surface defining the long hole 23Ba is equal to the distance between the front surface S1 of short tube 40Ba and an inner surface S3 of the ear pad 30B and the distance between the front surface S2 of sealing pad 45 and a rear surface S4 of the sound tube 20B. When the knob 42B reaches the front end surface defining the long hole 23Ba as shown in FIG. 8B, the front end surface of short tube 40Ba is brought into contact with the inner surface S3 of ear pad 30B, and the sealing pad 45 is tightly brought into contact with the rear surface S4 of sound tube 20B. As a result, the wide chamber 211*b* is isolated from the narrow conduit 212*b* between the inner surface of sound tube 20B and the outer surface of short tube 40Ba, and the inner space of short tube 40Ba is isolated from the sound hole 32B between the inner surface of tubular portion 30Ba and the outer surface of short tube 40Ba.

Description is hereinafter made on behavior of switching mechanism 40B. When the user wishes to emphasize the lower register, or when the user wishes to hear the outside sound, he or she pushes the knob 42B in the direction toward the signal-to-sound converter 10B. The knob 42B and short tube 40Ba slide on the innermost surfaces of two sets of small projections 213 and 214, and the front end surface S1 and sealing pad 45 are spaced from the inner surfaces S3 and S4, respectively. Then, the switching mechanism 40B enters the open state. The circular hole 23*a* is connected through the narrow conduit 212*b* to both of the sound hole 32B and wide chamber 211*b*, and the hole 33 is also connected to the sound hole 32B as shown in FIGS. 8A and 8B. In this situation, the diaphragm 10Bc of signal-to-sound converter 10B becomes well vibrating, and the lower register of inside sound is emphasized. The inside sound is propagated through the sound propagation hole 21B as indicated by arrow AS3, and is radiated through the sound hole 32B into the acoustic meatus of user.

The outside sound passes through the holes 23Ba and 33 directly into the sound hole 32B and through the narrow conduit 212*b*, wide chamber 211*b* and inner space of short tube 40Ba as indicated by arrow AS4, and is also radiated through the sound hole 32B into the acoustic meatus of user. In case where the user wishes to hear the voice of another person, the user may turn off the source of inside sound signal, and makes only the outside sound reach the acoustic meatus.

On the other hand, when the user wishes to emphasize the higher register of inside sound, he or she pushes the knob 42B in a direction toward the ear pad 30B, i.e., a direction indicated by an arrow A2. The knob 42B and short tube 40Ba slide on the innermost surfaces of two sets of small projections 213 and 214 in the direction indicated by the arrow A2, and the front end surface S1 of short tube 40Ba and the front surface S2 of sealing pad 45 are brought into contact with the inner surfaces S3 and S4, respectively. Then, the switching mechanism 40B is changed to the closing state, and the holes 23Ba and 33 are isolated from the wide chamber 211*b*, and only the inside sound is propagated through the wide chamber 211*b* and inner space of short tube 40Ba into the acoustic meatus of user as indicated by arrow AS3 in FIG. 8B.

In this situation, the outside sound is confined in the ring-shaped space outside the short tube 40Ba, and does not reach the acoustic meatus. Only the inside sound is propagated through the sound propagation hole 21B and inner space of short tube 40Ba, and is radiated into the acoustic meatus. On the other hand, the inside sound is confined in the wide chamber 211*b*, inner space of short tube 40Ba and acoustic meatus so that the vibrations of diaphragm are restricted. For this reason, the higher register of inside sound is emphasized.

As will be understood from the foregoing description, the switching mechanism 40B is changed between the open state and the closing state through the sliding movement in the direction parallel to the centerline of sound tube 20B. While the user is exerting the force on the knob 42B, the exerted force gives rise to the sliding of the knob 42B and short tube 40Ba. Although the short tube 40Ba exerts force on the ear pad 30B after the contact between the front end surface S1 and the inner surface S3, the force causes the ear pad 30B to be further inserted deeply in the acoustic meatus. For this reason, the ear pad 30B is not dropped off from the acoustic meatus.

Fourth Embodiment

Figure 9A:
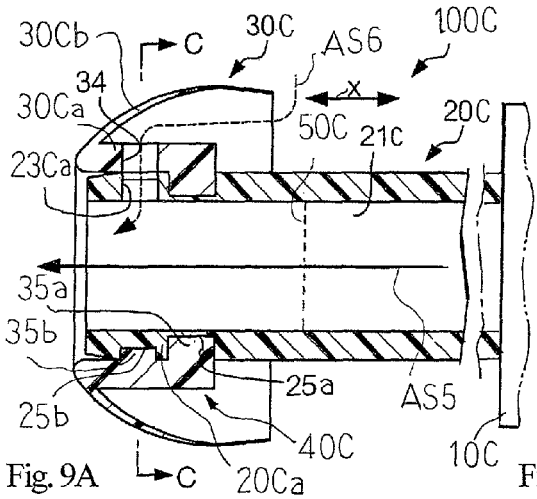
FIG. 9A is a cross sectional view showing still another inserting type earphone device of the present invention.
Figure 9B:
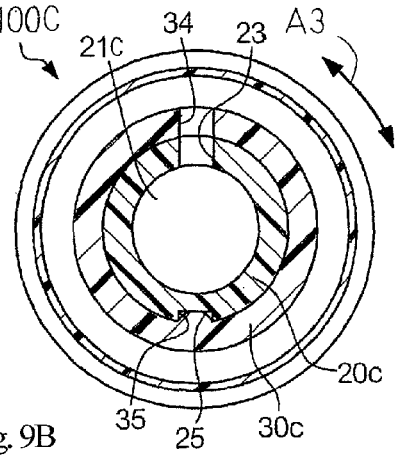
FIG. 9B is a cross sectional view taken along line C-C of FIG. 9A and showing an switching mechanism incorporated in the inserting type earphone device.

Turning to FIGS. 9A and 9B of the drawings, still another inserting type earphone device 100C comprises a signal-to-sound converter 10C, a sound tube 20C, an ear pad 30C, a switching mechanism 40C and a dust filter 50C. The signal-to-sound converter 10C is same as the signal-to-sound converter 10. A part of the switching mechanism 40C form a unitary structure together with the sound tube 20C, and a remaining part of the switching mechanism 40C and ear pad 30C form another unitary structure as will be hereinafter described in detail.

The sound tube 20C has a cylindrical configuration, and the inner space of sound tube 20C serves as a sound propagation hole 21C. The centerline of sound propagation hole 21C extends in a direction parallel to an arrow x in FIG. 9A. The sound tube 20C has a front portion 20Ca, which serves as the part of the switching mechanism 40C. Ring-shaped grooves 25*a* and 25*b* are defined in the outer surface portion 20Ca, and a hole 23Ca is further formed in the front portion 20Ca. The hole 23Ca is open at one end thereof to the outer surface of sound tube 20C and at the other end thereof to the sound propagation hole 21C.

The filter 50C is stretched across the sound propagation hole 21C, and prevents the sound propagation hole 21*c* from the signal-to-sound converter 10C and the filter 50C from dust and contamination, which invade the sound propagation hole 21C through the holes 34 and 23Ca.

The ear pad 30C has a tubular portion 30Ca and a flared portion 30Cb. The flared portion 30Cb is deformable, and is tightly brought into contact with the skin defining the acoustic meatus. The tubular portion 30Ca has an inner diameter approximately equal to the outer diameter of the sound tube 20C, and is formed with collars 35*a* and 35*b*. The collars 35*a* and 35*b* inwardly project from the inner surface of the tubular portion 30Ca. The collars 35*a* and 35*b* have width slightly shorter than the width of the ring-shaped grooves 25*a* and 25*b*, and height slightly shorter than the depth of the ring-shaped grooves 25*a* and 25*b*. The sound tube 20C is inserted into the tubular portion 30Ca, and the collars 35*a* and 35*b* are respectively received in the ring-shaped grooves 25*a* and 25*b*. The tubular portion 30Ca is further formed with a hole 34, and the hole 34 is open at one end thereof to the outer surface of tubular portion 30Ca and at the other end thereof to the inner surface of tubular portion 30Ca. When the collars 35*a* and 35*b* are received in the ring-shaped grooves 25*a* and 25*b*, the distance between the collar 35*a* to the hole 34 is approximately equal to the distance between the ring-shaped groove 25*a* and the hole 23Ca.

The ear pad 30C and sound tube 20C are relatively rotatable. While the ear pad 30C and sound tube 20C are relatively rotated, the collars 35*a* and 35*b* are moved in the ring-shaped grooves 25*a* and 25*b* in a circumferential direction A3. When the hole 34 is overlapped with the hole 23Ca, the sound propagation hole 21C is connected through the holes 23Ca and 34 to the outside of sound tube 20C. On the other hand, when the hole 30Ca is offset from the hole 23Ca, the sound propagation hole 21C is isolated from the outside of sound tube 20C. Thus, the front portion 20Ca, in which the ring-shaped grooves 25*a* and 25*b* and hole 23Ca is formed, and the tubular portion 30Ca, in which the collars 35*a* and 35*b* and hole 34 is formed, forms in combination the switching mechanism 40C.

When the user wishes to emphasize the lower register, or when the user wishes to hear the outside sound, he or she rotates the sound tube 20C or ear pad 30C, the sound tube 20C and ear pad 30C are relatively rotated, and the hole 23Ca is overlapped with the hole 34 through the relative rotation between the sound tube 20C and the ear pad 30C. In this situation, the sound propagation hole 21C is connected to the outside through the holes 23Ca and 34 as shown in FIGS. 9A and 9B. In this situation, the diaphragm of signal-to-sound converter 10C becomes well vibrating, and the lower register of inside sound is emphasized. The inside sound is propagated through the sound propagation hole 21 as indicated by arrow AS5, and is radiated into the acoustic meatus of user.

The outside sound passes through the holes 34 and 23Ca into the sound propagation hole 21C as indicated by arrow AS6, and is also radiated into the acoustic meatus of user. In case where the user wishes to hear the voice of another person, the user may turn off the source of sound signal, and makes only the outside sound reach the acoustic meatus.

On the other hand, when the user wishes to emphasize the higher register of inside sound, he or she gives rise to relative rotation between the sound tube 20C and the ear pad 30C. The sound tube 20C and ear pad 30C are relatively rotated in the opposite direction, and the hole 34 is offset from the hole 23Ca. Then, the switching mechanism 40C is changed to the closing state, and the sound propagation hole 21C is isolated from the outside.

In this situation, the inside sound is confined in the sound propagation hole 21C and acoustic meatus, and the vibrations of diaphragm are restricted. For this reason, the higher register of inside sound is emphasized. The sound propagation hole 21C is blocked from the outside sound by means of the tubular portion 30Ca. Only the inside sound is propagated through the sound propagation hole 21C as indicated by the arrow AS5, and is radiated into the acoustic meatus.

As will be understood from the foregoing description, the switching mechanism 40C is changed between the open state and the closing state through the relative rotation between the sound tube 20C and the ear pad 30C. While the user is exerting the force on the sound tube 20C in the circumferential direction, the exerted force gives rise to the rotation of the sound tube 20C. Although the friction between the sound tube 20C and the ear pad 30C may cause the ear pad 30C to rotate inside the acoustic meatus, the friction between the ear pad 30C and the skin is much larger than the friction between the sound tube 20C and the ear pad 30C, and the ear pad 30C is hardly rotated. Any component force to pull out the ear pad 30C is not exerted on the ear pad 30C, and, accordingly, the ear pad 30C is not inclined in the acoustic meatus. For this reason, the ear pad 30C is not dropped off from the acoustic meatus.

Fifth Embodiment

Figure 10A:
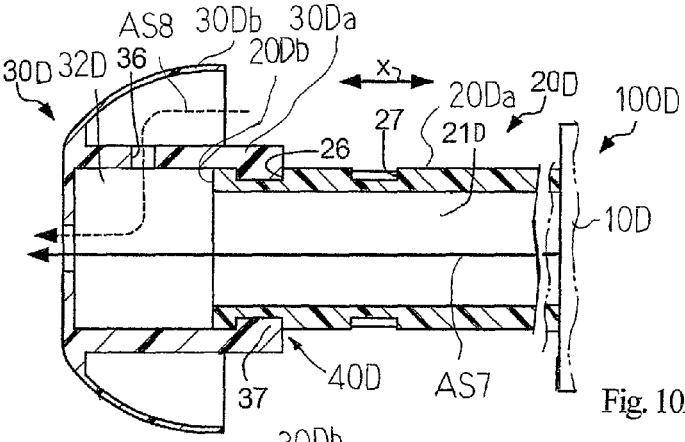
FIG. 10A is a cross sectional view showing yet another inserting type earphone device of the present invention in open state.
Figure 10B:
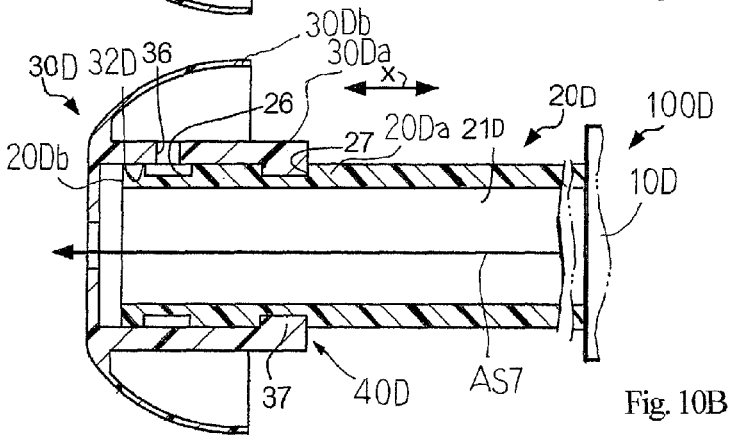
FIG. 10B is a cross sectional view showing the inserting type earphone device in closed state.
Figure 11:
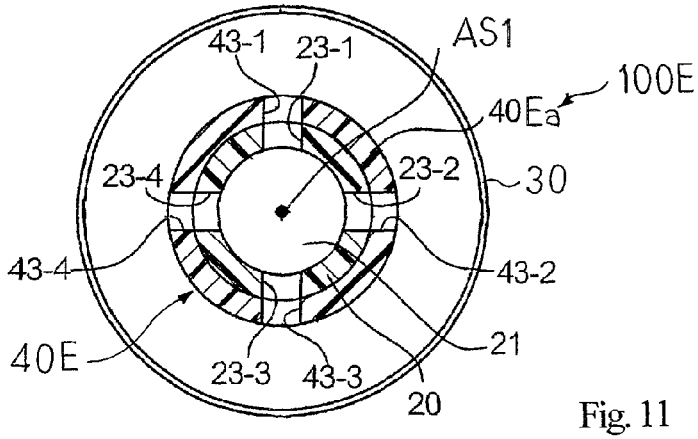
FIG. 11 is a cross sectional view showing a first modification of the inserting type earphone device shown in FIGS. 1 to 5B.

Turning to FIGS. 10A and 10B of the drawings, yet another inserting type earphone device 100D embodying the present invention largely comprises a signal-to-sound converter 10D, a sound tube 20D, an ear pad 30D and a switching mechanism 40D. The signal-to-sound converter 10D is same as the signal-to-sound converter 10. A part of the sound tube 20D and a part of the ear pad 30D form in combination the switching mechanism 40D as similar to the fourth embodiment.

The sound tube 20D has a cylindrical configuration, and a sound propagation hole 21D is formed in the sound tube 20D. The sound tube 20D is made of synthetic resin, and is relatively thin. For this reason, when users strongly pinch the outer surface of sound tube 20D between the thumb and a finger, the sound tube 20D is deformed.

The sound tube 20D has an outer surface portion 20Da, and grooves 26 and 27 are formed in the outer surface portion 20Da. The grooves 26 and 27 are spaced from each other in a direction indicated by arrow x in FIGS. 10A and 10B, and the outer surface portion 20Da serves as the part of switching mechanism 40C. The grooves 26 and 27 may be ring-shaped.

The ear pad 20D has a tubular portion 30Da and a flared portion 30Db. The flared portion 30Db is deformable, and is tightly brought into contact with the skin defining the acoustic meatus. The tubular portion 30Da has an inner diameter, which is approximately equal to the outer diameter of sound tube 20D. For this reason, the sound tube 20D is insertable into the tubular portion 30Da. When the user deforms the sound tube 20D between the thumb and the finger, the sound tube 20D becomes loose, and is moved in the tubular portion 30Da as indicated by the arrow x in FIGS. 10A and 10B.

The tubular portion 30Da is formed with a projection 37, which inwardly projects from the inner surface of the tubular portion 30Da. In case where the grooves 26 and 27 are ring-shaped, the projection 37 is also ring-shaped. The projection 37 has height approximately equal to the depth of grooves 26 and 27, and width approximately equal to the width of grooves 26 and 27. For this reason, the projection 37 is brought into mating engagement with the grooves 26 and 27.

A hole 36 is formed in the tubular portion 30Da, and is open at one end thereof to the outer surface of tubular portion 30Da and at the other end thereof to the inner surface of tubular portion 30Da. The distance between the hole 36 and the projection 37 is longer than the distance between the front end surface 20Db of sound tube 20D and the groove 26, and is shorter than the distance between the front end surface 20Db and the other groove 27. When the projection 37 is received in the groove 26, the front end surface 20Db does not reach the hole 36, and the sound propagation path 21D is connected to the outside of sound tube 20D through the hole 36. On the other hand, when the projection 37 is moved to the other groove 27, the hole 36 is closed with the sound tube 20D, and the sound propagation hole 21D is isolated from the outside of sound tube 20D.

Description is hereinafter made on behavior of switching mechanism 40D. When the user wishes to emphasize the lower register, or when the user wishes to hear the outside sound, he or she pulls out the sound tube 20D from the ear pad 30D, and makes the projection 37 received in the groove 26. The front end surface 20Db is offset from the hole 36, and the switching mechanism 40D enters the open state. The hole 36 is connected to the sound propagation hole 21D as shown in FIG. 10A. In this situation, the diaphragm of signal-to-sound converter 10B becomes well vibrating, and the lower register of inside sound is emphasized. The inside sound is propagated through the sound propagation hole 21D as indicated by arrow AS7, and is radiated through the sound hole 32D into the acoustic meatus of user.

The outside sound passes through the hole 36 directly into the sound hole 32D, and is also radiated through the sound hole 32D into the acoustic meatus of user. In case where the user wishes to hear the voice of another person, the user may turn off the source of inside sound signal, and makes only the outside sound reach the acoustic meatus.

On the other hand, when the user wishes to emphasize the higher register of inside sound, he or she pushes the sound tube 20D into the tubular portion 30Da, and the projection 37 is received in the groove 27 as shown in FIG. 10B. Then, the hole 36 is closed with the sound tube 20D, and the switching mechanism 40D is changed to the closing state. The sound propagation hole 21D is isolated from the outside. Only the inside sound is propagated through the sound propagation hole 21D into the acoustic meatus of user.

In this situation, the inside sound is confined in the sound propagation hole 21D and acoustic meatus so that the vibrations of diaphragm are restricted. For this reason, the higher register of inside sound is emphasized.

As will be understood from the foregoing description, the switching mechanism 40D is changed between the open state and the closing state through the sliding movement in the direction parallel to the centerline of sound tube 20D. While the user is pushing the sound tube 20D into the tubular portion 30Da, the ear pad 30D is merely inserted into the acoustic meatus deeply, and is not dropped off. When the user pulls out the sound tube 20D from the tubular portion 30Da, the user makes the sound tube 20D loosed through the deformation of sound tube 20D, and, thereafter, pulls out the sound tube 20D. Although part of the pulling force is exerted on the ear pad 30D, the friction between the ear pad 30D and the skin is much larger than the pulling force. For this reason, the ear pad 30D is not dropped off from the acoustic meatus.

A Modification of First Embodiment

An inserting type earphone device 100E is a modification of the inserting type earphone device 100, and includes a switching mechanism 40E. The switching mechanism 40E has a short tube 40Ea. The inserting type earphone device 100E is different from the inserting type earphone device 100 in that the circular hole 23*a* and circular hole 43*a* are replaced with four circular holes 23-1, 23-2, 23-3 and 23-4 and four circular holes 43-1, 43-2, 43-3 and 43-4, respectively. The other features of inserting type earphone device 100E are same as those of the inserting type earphone device 100. For this reason, the other component parts and portions are labeled with the references designating the corresponding component parts and portions of the inserting type earphone device 100 without detailed description.

The four circular holes 23-1, 23-2, 23-3 and 23-4 are spaced from one another by 90 degrees, and the four circular holes 43-1, 43-2, 43-3 and 43-4 are also spaced from one another by 90 degrees. When a user changes the switching mechanism 40E from the open state to the closing state, he or she rotates the short tube 40Ea by a certain angle not equal to 90 degrees, 180 degrees 270 degrees and 360 degrees.

The plural pairs of circular holes 23-1 to 23-4 and 43-1 to 43-4 are desirable, because the outside sound may be radiated from a source on either side of inserting type earphone device 100E or below the inserting type earphone device 100E.

A Modification of Second Embodiment

A modification of inserting type earphone device 100A includes a sound tube formed with more than one circular hole and a short tube formed with more than one circular hole. The more than one circular hole may be spaced from one another in the circumferential direction of the tubes or in the directions parallel to the arrow x.

Figure 12A:
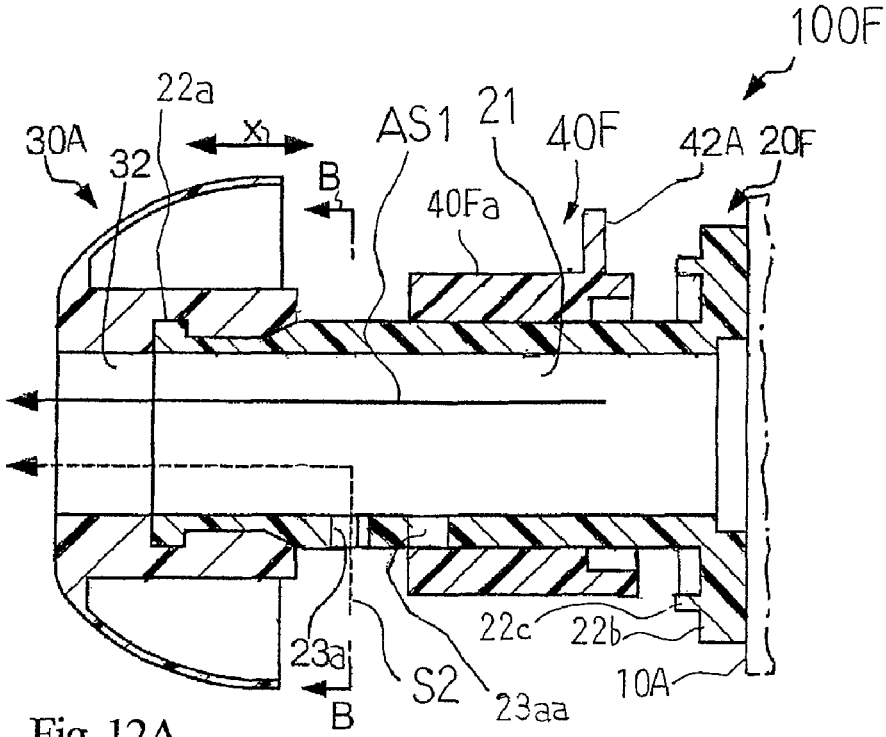
FIG. 12A is a cross sectional view showing a first modification of the inserting type earphone device show in FIGS. 6A to 7B in semi-open state.
Figure 12B:
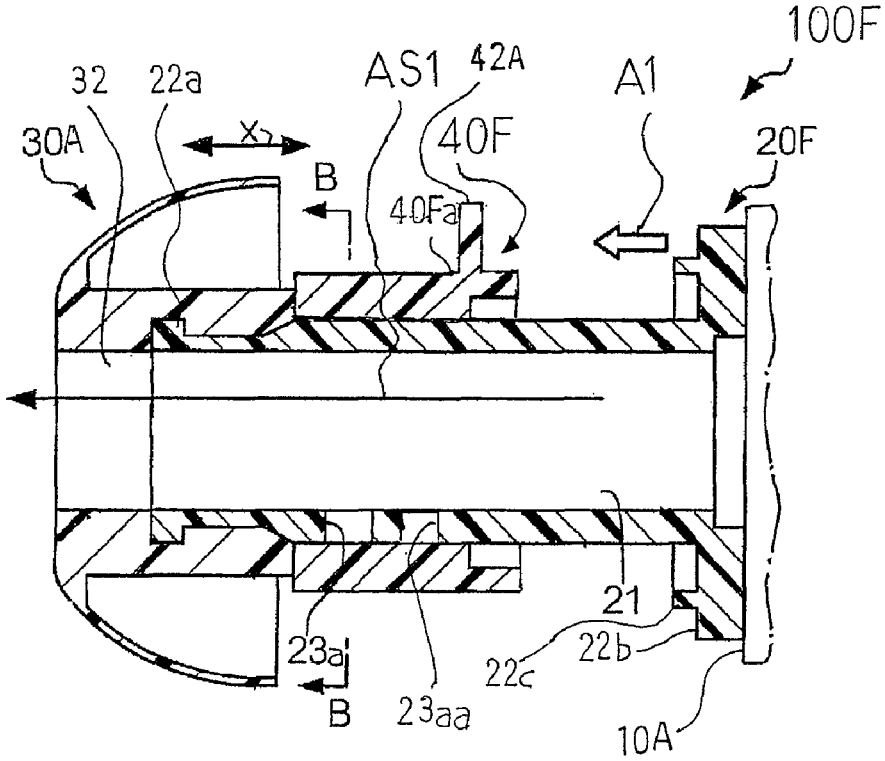
FIG. 12B is a cross sectional view showing the first modification of the inserting type earphone device in the closed state.

In case where the more than one circular hole is spaced from one another in the direction parallel to the arrow x, the user can change the number of circular holes open to the outside. FIGS. 12A and 12B show an inserting type earphone device 100F serving as the modification. The inserting earphone device 100F includes a sound tube 20F, and the sound tube 20F is formed with a circular hole 23*aa* in addition with the circular hole 23*a*. The circular hole 23*aa* is spaced from the circular hole 23*a* in the direction indicated by the arrow x. The inserting type earphone device 100F further includes a switching mechanism 40F, and the switching mechanism 40F has a short tube 40Fa. The short tube 40Fa is shorter than the short tube 40Aa. The other component parts of inserting type earphone device 100F are same as those of the inserting type earphone device 100A, and, for this reason, the other component parts are labeled with the references designating corresponding component parts of inserting type earphone device 100A.

While the user wishes to hear only the inside sound with the emphasis of higher register tones, both of the circular holes 23*a* and 23*aa* are closed with the short tube 40Fa as shown in FIG. 12B. When the user wishes to monitor the outside sound 40Fa, he or she moves the short tube in the direction toward the rear flange 22*b*. The circular hole 23*a* is exposed to the outside on the way to the rear flange 22*b*, and the other circular hole 23*aa* is still closed with the short tube 40Fa as shown in FIG. 12A. The switching mechanism enters semi-open state. A small amount of outside sound enters the sound propagation hole 21 so that the user can monitor the outside sound.

When the user wishes clearly to hear the outside sound, he or she further moves the short tube 40Fa until the short tube 40Fa is brought into contact with the rear flange 22*b*. Then both of the circular holes 23*a* and 23*aa* are exposed to the outside, and a large mount of outside sound enters the sound propagation hole 21.

Thus, the inserting type earphone device permits the user to control the loudness of outside sound through change of the number of circular holes open to the outside. All the advantages of the inserting type earphone device 100A are achieved by using the inserting type earphone device 100F.

Another Modification of Second Embodiment

Another modification is different from the inserting type earphone device 100A in a threaded engagement between the sound tube and the short tube. A male screw and a female screw are formed in the outer surface portion of sound tube and the inner surface portion of short tube, and are held in threaded engagement with each other. When the user pushes the knob 42A in the circumferential direction of sound tube, the short tube and sound tube are relatively rotated, and the short tube is moved in the direction parallel to the centerline of sound tube. Thus, the user gives rise to the relative motion between the sound tube and the short tube through both of the rotation and axial movement.

A Modification of Third Embodiment

Figure 13A:
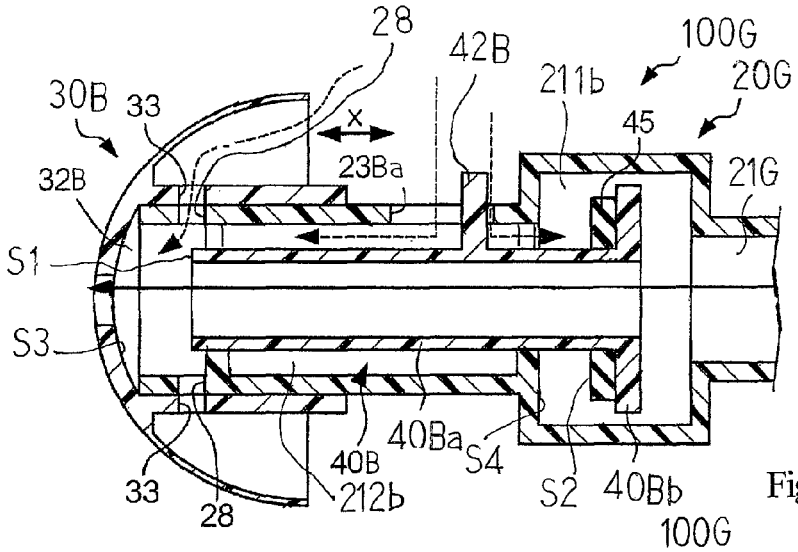
FIG. 13A is a cross sectional view showing a modification of the inserting type earphone device shown in FIGS. 8A and 8B in the open state.
Figure 13B:
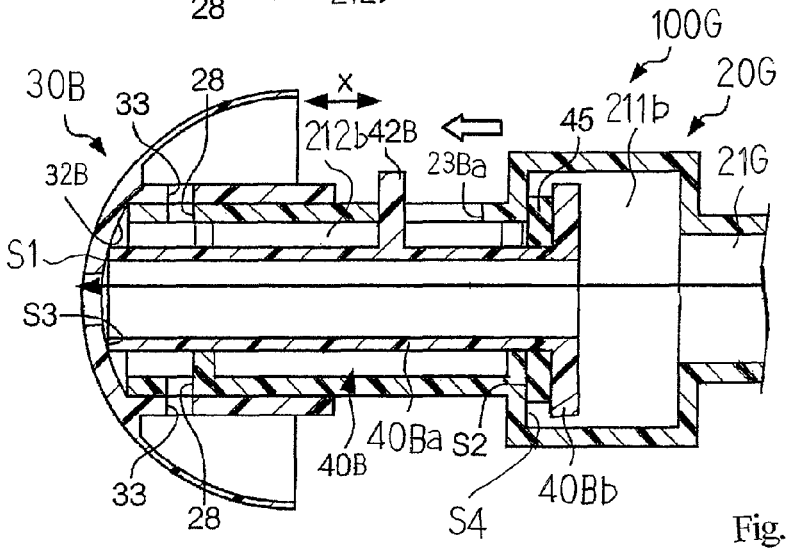
FIG. 13B is a cross sectional view showing the modification in the closed state.

FIGS. 13A and 13B show a modification 100G of the inserting type earphone device 100B. The inserting type earphone device 100G is different from the inserting type earphone device 100B in a sound tube 20G, and the other component parts are same as those of the inserting type earphone device 100B. For this reason, the other component parts of inserting type earphone device 100G are labeled with references, which designate the corresponding component parts of inserting type earphone device 100B.

The sound tube 20G is longer than the sound tube 20B, and a front end surface of sound tube 20B is held in abutting engagement with the inner surface S3 of ear pad 30B. The sound tube 20G is secured to the ear pad 30B. In order to make the holes 33 open to the sound propagation hole 21G of sound tube 20G, holes 28 are formed in a front end portion of sound tube 20G, and are aligned with the holes 33, respectively.

The switching mechanism 40B behaves as similar to that of the inserting type earphone device 100B. When the know 42B is brought in contact with the rear end surface partially defining the long hole 23Ba as shown in FIG. 13A, the front end surface S1 is spaced from the inner surface S3, and the switching mechanism 40B is changed to the open state. Then, the outside is connected to the sound hole 32B through the holes 33 and 28, and the outside sound is radiated from the sound hole 32B to the acoustic meatus. Since the sealing pad 45 is spaced from the surface S2, the outside sound is further propagated through the wide chamber 211*b* and inner space of short tube 40Ba into the sound hole 32B, and is radiated into the acoustic meatus. The lower register of inner sound is emphasized.

On the other hand, when the knob 42B is brought into contact with the front end surface defining the long hole 23Ba as shown in FIG. 13B, the front end surface S1 is brought into contact with the inner surface S3, and the front surface S2 of sealing pad 45 is also brought into contact with the surface S4. The holes 33 and 28 and space between the inner surface of sound tube 20G and the outer surface of short tube 40Ba are isolated from the inner space of short tube 40Ba and wide chamber 211*b*. For this reason, only the inner sound is radiated into the acoustic meatus. The higher register of inner sound is emphasized.

Another Modification of Third Embodiment

Figure 14:
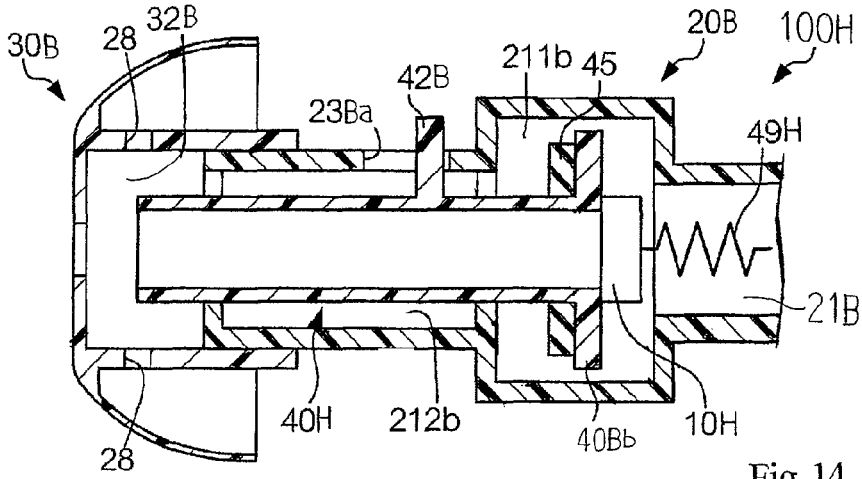
FIG. 14 is a cross sectional view showing another modification of the inserting type earphone device shown in FIGS. 8A and 8B.

Turning to FIG. 14 of the drawings, another modification 100H is different from the inserting type earphone device 100B in that a signal-to-sound converter 10H is fitted to the short tube 40Bb. The signal-to-sound converter 10H is moved together with the short tube 40Bb in the direction parallel to the centerline of sound tube 20B. The inside sound is radiated from the signal-to-sound converter 10H to the inner space of the short tube 40Bb. The inside sound is propagated through the inner space of short tube 40Bb and sound hole 32B, and is radiated into the acoustic meatus.

The inserting type earphone device 100H is further different from the inserting type earphone device 100B in that an elastic member 49H such as, for example, a coil spring is provided between the signal-to-sound converter 10H and the sound tube 20B. The elastic member 49H prevents the signal-to-sound converter 10H and short tube 40Bb from vibrations, which undesirably occur during the movements of short tube 40Bb and signal-to-sound converter 10H, so as to keep the quality of inside sound.

The other features are same as those of the inserting type earphone device 100B, and no further description is hereinafter incorporated.

Yet Another Modification of Third Embodiment

Figure 15A:
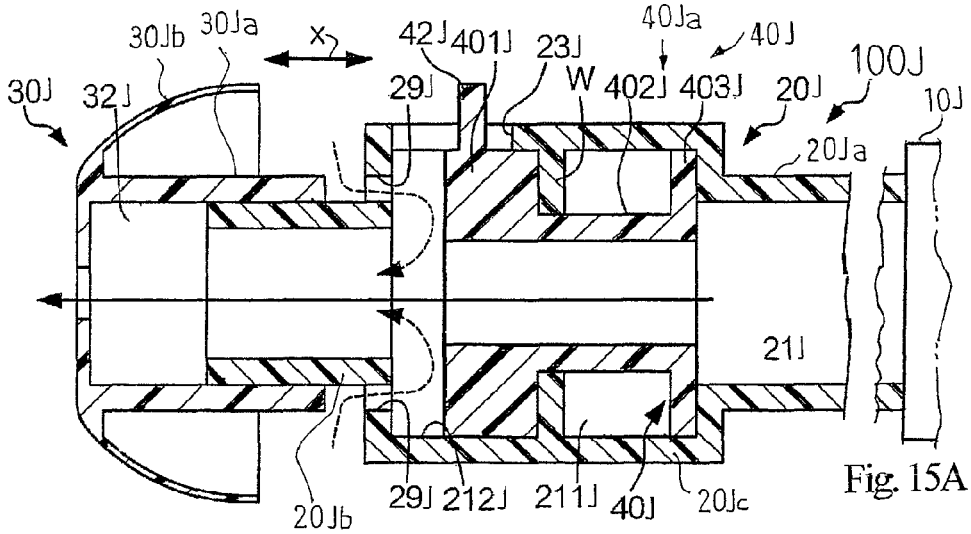
FIG. 15A is a cross sectional view showing yet another modification of the inserting type earphone device shown in FIGS. 8A and 8B in the open state.
Figure 15B:
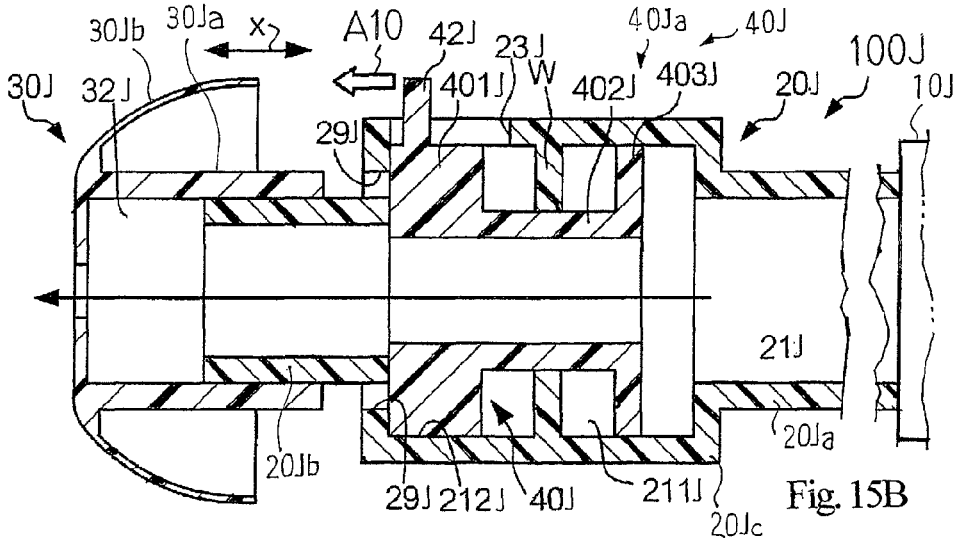
FIG. 15B is a cross sectional view showing the modification in the closed state.

Turning to FIGS. 15A and 15B, yet another modification 100J of the inserting type earphone device 100B includes a signal-to-sound converter 10J, a sound tube 20J, an ear pad 30J and a switching mechanism 40J. The signal-to-sound converter 10J is same as the signal-to-sound converter 10, and no further description is hereinafter incorporated for the sake of simplicity.

The sound tube 20J has tubular portions 20Ja and 20Jb and a wide chamber portion 20Jc, and the wide chamber portion 20Jc is sandwiched between the tubular portions 20Ja and 20Jb. A sound propagation hole 21*j* is defined in the tubular portions 20Ja and 20Jb and wide chamber portion 20Jc, and the inner space 211*j* of wide chamber portion 20Jc makes the sound propagation hole 21*j* partially widened. A long hole 23J and circular holes 29J are formed in a front end wall and a tubular wall of the wide chamber portion 20Jc, and a ring-shaped wall W projects from the inner surface of wide chamber portion 20Jc into the inner space 211J.

The ear pad 30J has a tubular portion 30Ja and a flared portion 30Jb, and the flared portion 30Jb is connected to the front end of tubular portion 30Ja. A sound hole 32J is defined in the tubular portion 30Ja, and is open to the outside. The tubular portion 20Jb is inserted into the tubular portion 30Ja. The rear end surface of tubular portion 30Ja is spaced from the front end surface of wide chamber portion 20Jc so that the circular holes 29J are open to the outside of the inserting type earphone device 100J.

The switching mechanism 40J includes a short tube 40Ja and a knob 42J, and the short tube 40Ja is provided in the inner space 211J. The short tube 40Ja has a thick portion 401J and 403J and a thin portion 402J. The thin portion 402J is sandwiched between the thick portions 401J and 403J, and the knob 42J projects from the thick portion 401J through the long hole 23J into the outside. The outer diameter of thick portions 401J and 403J is approximately equal to the inner diameter of wide chamber portion 20Jc, and the outer diameter of thin portion 402J is approximately equal to the inner diameter of ring-shaped wall W. For this reason, the thick portions 401 and 403J are slidable on the inner surface 212J of wide chamber portion 20Jc, and the thin portion 402J is slidable on the innermost surface of ring-shaped wall W.

Users changes the switching mechanism 40J between the open state and the closing state by pushing the knob 42J in directions indicated by arrow x in FIGS. 15A and 15B.

When a user wishes to emphasize lower register of inside sound, or when the user wishes to hear the outside sound, he or she pushes the knob 42J toward the signal-to-sound converter 10J, and gives rise to the sliding movement of short tube 40J on the inner surface 212J and innermost surface of ring-shaped wall W. When the thick portion 401J is brought into contact with the ring-shaped wall W as shown in FIG. 15A, the sound propagation hole 21*j* is connected to the outside of inserting type earphone device 100J, and the lower register of inside sound is emphasized. Moreover, the outside sound enters the sound propagation hole 21J, and both of the inside sound and outside sound are radiated into the acoustic meatus.

On the other hand, when the user wishes to emphasize the higher register of inside sound, or when the user wishes to hear only the inside sound, he or she pushes the knob 42J toward the ear pad 30J, i.e., in a direction indicated by an arrow A10, the thick portions 401J and 403J slide on the inner surface 212J, and the thin portion 402J slides on the innermost surface of ring-shaped wall W. The thick portion 401J is brought into contact with the front end wall of wide chamber portion 20Jc, and the circular holes 29J are closed with the thick portion 401J. As a result, the outside sound is not permitted to enter the sound propagation hole 21J. The vibrations of diaphragm are restricted, and the higher register of inside sound is emphasized.

As will be appreciated from the foregoing description, the switching mechanism 40 to 40J are changed between the open state and the closing state through the linear motion in the direction toward the ear pads and opposite direction, through the rotation about the centerlines of sound tubes and through the combination of the linear motion and rotation. The linear motion, rotation and the combination between the linear motion and rotation do not cause the ear pads 30 to 30J to be inclined in the acoustic meatus. For this reason, the inserting type earphone devices 100 to 100J are stable in the acoustic meatus in the change of switching mechanisms 40 to 40J, and are not dropped off from the acoustic meatus.

In all the embodiments and modifications, the sound passages to the outside such as the circular holes 23*a* are closer to the eardrum of user than the corresponding holes of the prior art earphones. The positions of sound passages of the earphone devices of the present invention are desirable, because the users clearly hear the outside sounds. Moreover, the fresh air tends to penetrate into the acoustic meatus so that the users feel the earphone devices comfortable.

Although particular embodiments of the present invention have been shown and described, it will be apparent to those skilled in the art that various changes and modifications may be made without departing from the spirit and scope of the present invention.

An inserting type earphone device of the present invention may have two or more than two technical features of the above-described embodiments and modifications.

The compact disk player 201 does not set any limit to the technical scope of the present invention. The inserting type earphone device embodying the present invention is available for another sort of sound source such as, for example, a portable radio, a cassette recorder and reproducer, a hearing aid and so forth.

The ear pad 30 of silicone rubber does not set any limit to the technical scope of the present invention. An ear pad may be made of another sort of resilient material such as, for example, synthetic resin.

The sound tube 20 of synthetic resin does not set any limit to the technical scope of the present invention. A sound tube may be made of another sort of material such as, for example, light metal or fiber-reinforced carbon.

The single pair circular holes 23*a* and 43*a* and the four pairs of circular holes 23-1 to 23-4 and 43-1 to 43-4 do not set any limit to the technical scope of the present invention. Two pairs of circular holes, three pairs of circular holes or more than four pairs of circular holes may be formed in the sound tube and short tube of other modifications of the first embodiment. Moreover, the number of circular hole or holes of the sound tube may be different from the number of circular hole or holes of the short tube.

The circular holes 23*a*/43*a* and 23-1 to 23-4/43-1 to 43-4 do not set any limit to the technical scope of the present invention. The circular holes may be replaced with long holes, which extend in directions parallel to the arrow AS1.

A sealing pad of rubber may be adhered to the front surface of thick portion 401J so as to make the circular holes 29J hermetically closed with the short tube 40J.

The circular holes 29 may be formed in the rear end surface of the wide chamber portion 20Jc. In this instance, the circular hole 29 are closed with the thick portion 403J. When the switching mechanism 40J is changed to the open state, the outside sound is propagated through the circular holes 29, inner space 211J, inner space of short tube 40J and sound hole 32J into the acoustic meatus.

The sound tube and short tube may have respective cross section different from the circular cross section such as, for example, rectangular cross sections or polygonal cross sections.

The circular holes such as circular holes 23*a* and 43*a* do not set any limit to the technical scope of the present invention. The outside sound may enter the sound propagation holes through rectangular holes or polygonal holes.

The switching mechanisms 40 to 40J may be driven by means of a suitable actuator such as, for example, an electric motor unit or a solenoid-operated linear actuator. In this instance, the user turns on and off for activate or deactivate the actuator.

The inserting type earphone devices 100 to 100J may be disassembled into the signal-to-sound converters 10 to 10J, sound tubes 20 to 20J, ear pads 30 to 30J and switching mechanisms 40 to 40J. In this instance, the component parts are assembled into the inserting type earphone devices 100 to 100J through fitting. On the contrary, the sound tubes 20 to 20J and ear pads 30 to 30J may be formed into a unitary structure through molding, by way of example.

The rotatable short tube such as 40*a* does not set any limit to the technical scope of the present invention. The rotatable short tube 40*a* may be replaced with combination of a guide rail and a small plate. The guide rail is secured to the circumference of sound tube, and the small plate is movably connected to the guide rail. When a user changes the switching mechanism between the open state and the closing state, the user pushes the small plate along the guide rail, and stops the small plate at either proper position where the small plate is overlapped with or offset from the circular hole 23*a*. Thus, the tubular configuration is not any indispensable feature of the present invention.

Similarly, the short tubes 20A and 20B may be replaced with combination of a guide rail and a small plate. The guide rail is secured to the sound tube 40A and 40B, and extends in a direction parallel to the centerline of sound tube 40A and 40B. The small plate is movably connected to the guide rail. When a user changes the switching mechanism 40A or 40B between the open state and the closing state, the user pushes the small plate along the guide rail, and stops the small plate at either proper position where the small plate permits the hole 23*a* or 33 to be connected to or disconnected from the sound propagation hole 21 or 21B. Thus, the tubular configuration is also not any indispensable feature of the present invention.

Claim languages are correlated with the component parts of inserting type earphone devices 100 to 100J as follows.

The inserting earphone device 100, 100A, 100B, 100C, 100D, 100E, 100F, 100G, 100H and 100J serves as "an earphone device", and the audio signal AD1 is corresponding to "an audio signal." The signal-to-sound converter 10, 10A, 10B, 10C, 10D, 10F, 10G or 10J serves as "a signal-to-sound converter".

The sound tube 20, 20A, 20B, 20C, 20D, 20F, 20G or 20J and ear pad 30, 30A, 30B, 30C, 30D or 30J as a whole constitute "a sound propagation body", and the ear pad 30, 30A, 30B, 30C, 30D or 30J serves as "an inserting portion." The sound propagation hole 21, 21B, 21C, 21D, 21G or 21J is corresponding to "a sound propagation hole," and the circular hole 23*a*, 33Ca, 36 or holes 33, 23*a*/23*aa*, 28, 29 or 23-1 to 23-4 serve as "a sound hole." The switching mechanism 40, 40A, 40B, 40C, 40D, 40E, 40F, 40H or 40J is corresponding to "a switching mechanism."

The CD player 201 serves as "a source of inside sound."

The short tube 40*a* or 40Ea or tubular portion 30Ca serves as "a closing pad", which takes the relative rotation, and the circular hole 43*a*, circular holes 43-1, 43-2, 43-3 and 43-4 or hole 34 is corresponding to "a hollow space."

The ear pad 30C serves as the inserting portion, and the sound tube 20C is corresponding to "a remaining portion."

The short tube 40Aa, 40Ba, 40Fa or 40Ja or tubular portion 30Da serves as "a closing pad", which is moved in a direction parallel to the centerline of a sound propagation body, and the rear flange 40Bb and sealing pad 45 as a whole constitute "a flange portion." The hole 28 is corresponding to "another sound hole". The holes 23*a* and 23*aa* serve as "plural subholes."

The tubular portions 20Jb and 20Ja are corresponding to "a tubular portion" and "another tubular portion", respectively, and the wide chamber portion 20Jc is corresponding to "a wide chamber portion". The ring-shaped wall W serves as "an inner wall". The thick portions 401J and 403J serve as "a thick portion" and "another thick portion", and the thin portion 402J is corresponding to "a thin portion".

What is claimed is:

1. An earphone device for radiating sound into an acoustic meatus of a user, comprising:

a signal-to-sound converter supplied with an audio signal, and converting said audio signal to inside sound;

a sound propagation body connected to said signal-to-sound converter, having an inserting portion to be inserted into said acoustic meatus, and formed with a sound propagation hole defined therein for propagating said inside sound from said signal-to-sound converter to said acoustic meatus and a sound hole open at one end thereof to an environment; and a switching mechanism supported by said sound propagation body, and changed between open state where the other end portion of said sound hole is connected to said sound propagation hole and closing state where said sound hole is closed therewith through movements thereof in a direction parallel to a centerline of said sound propagation hole or rotation about said centerline.

2. The earphone device as set forth in claim 1, in which said switching mechanism has a closing pad, and said closing pad and said sound propagation body are relatively rotated so that said closing pad and said sound propagation body are changed between a position where said sound hole is closed and another position where said sound hole is connected to said sound propagation hole through the relative rotation.

3. The earphone device as set forth in claim 2, in which said closing pad has a tubular configuration formed with a hollow space inside thereof, and said sound propagation body is inserted into said closing pad for said relative rotation.

4. The earphone device as set forth in claim 3, in which said sound hole is formed by plural holes.

5. The earphone device as set forth in claim 2, in which said sound propagation body further has a remaining portion formed with another sound hole, and a part of said remaining portion is overlapped with said inserting portion so that said sound hole and said another sound hole are overlapped with and offset from each other through said relative rotation.

6. The earphone device as set forth in claim 1, in which said switching mechanism has a closing pad, and said closing pad and said sound propagation body are relatively moved in a direction parallel to said centerline said closing pad and said sound propagation body are changed between a position where said sound hole is closed and another position where said sound hole is connected to said sound propagation hole through the relative movements in said direction parallel to said centerline.

7. The earphone device as set forth in claim 6, in which said closing pad has a tubular configuration formed with a hollow space inside thereof, and said sound propagation body is inserted into said hollow space for said relative movements.

8. The earphone device as set forth in claim 6, in which said closing pad is provided inside said sound propagation body, and is formed with an inner space, wherein said closing pad makes said sound propagation hole connected to said acoustic meatus through said inner space and said sound hole isolated from said sound propagation hole in said closing state, wherein said closing pad makes said sound hole connected through said sound propagation hole to said acoustic meatus in said open state.

9. The earphone device as set forth in claim 8, in which said sound propagation body includes an ear pad serving as said inserting portion and having a tubular portion formed with said sound hole and a flared portion flared from one end of said tubular portion and deformed in said acoustic meatus, and an sound tube partially inserted into said tubular portion without closing said sound hole and accommodating said closing pad so that said sound hole is open to a hollow space between an outer surface of said closing pad and an inner surface of said sound tube, wherein said closing pad has an end surface held in contact with an inner surface of said tubular portion and a flange portion held in contact with an inner surface of said sound tube in said closing state so that said hollow space between said outer surface of said closing pad and said inner surface of said sound tube is confined between said closing pad and said ear pad and between said closing pad and said sound tube, wherein said end surface and said flange portion of said closing pad are spaced from said inner surface of said tubular portion and said inner surface of said sound tube in said open state so that said hollow space between said outer surface of said closing pad and said inner surface of said sound tube is connected through said sound propagation hole to said acoustic meatus.

10. The earphone device as set forth in claim 8, in which said sound propagation body includes an ear pad serving as said inserting portion and having a tubular portion formed with said sound hole and a flared portion flared from one end of said tubular portion and deformed in said acoustic meatus, and an sound tube inserted into said tubular portion until being held in contact with an inner surface of said one end of said tubular portion, formed with another sound hole overlapped with said sound hole and accommodating said closing pad so that said sound hole is open through said another sound hole to a hollow space between an outer surface of said closing pad and an inner surface of said sound tube, wherein said closing pad has an end surface held in contact with said inner surface of said tubular portion and a flange portion held in contact with an inner surface of said sound tube in said closing state so that said hollow space between said outer surface of said closing pad and said inner surface of said sound tube is confined between said closing pad and said ear pad and between said closing pad and said sound tube, wherein said end surface and said flange portion of said closing pad are spaced from said inner surface of said tubular portion and said inner surface of said sound tube in said open state so that said hollow space between said outer surface of said closing pad and said inner surface of said sound tube is connected through said sound propagation hole to said acoustic meatus.

11. The earphone device as set forth in claim 8, in which said closing pad has a knob projecting into an outside of said sound propagation body through a long hole formed in said sound propagation body so that a user pushes said knob in said direction parallel to said centerline for the movements of said closing pad.

12. The earphone device as set forth in claim 8, in which said sound propagation body includes an ear pad serving as said inserting portion, a sound tube formed with said sound propagation hole and having a tubular portion inserted into said ear pad, another tubular portion, and a wide chamber portion connected between said tubular portion and said another tubular portion, larger in diameter than said tubular portion and said another tubular portion and having an outer wall at a boundary to said tubular portion formed with said sound hole and an inner wall inwardly projecting from an inner surface of said wide chamber portion and formed with an inner space where said closing pad passes, and in which said closing pad has a thick portion provided inside said wide chamber portion between said outer wall and said inner wall, another thick portion provided inside said wide chamber portion on the opposite side to the inner space occupied by said thick portion with respect to said inner wall, and a thin portion connected between said thick portion and said another thick portion, and movably passing said inner space defined by said inner wall, wherein said thick portion is held in contact with said outer wall so as to close said sound hole in said closing state, and is spaced from said outer wall so as to permit said sound hole to be connected through said sound propagation hole to said acoustic meatus.

13. The earphone device as set forth in claim 6, in which said sound propagation body includes an ear pad having a tubular portion formed with sound hole and having a projection inwardly projecting from an inner surface thereof and a flared portion flared from one end of said tubular portion and deformable in said acoustic meatus, and a sound tube inserted into said tubular portion and formed with grooves open to an outer surface thereof and spaced from each other in a direction parallel to said centerline, wherein said projection is received in one of said grooves closer to said ear pad than another of said grooves in said open state so that said sound hole is connected to said sound propagation hole, wherein said projection is received in said another of said grooves in said closing state so that said sound hole is closed with an outer surface of said sound tube.

14. The earphone device as set forth in claim 6, in which said sound hole is formed by plural sub-holes spaced from one another in said direction parallel to said centerline, and one of said plural sub-holes is closed with said closing pad in intermediate state between said open state and said closing state.

15. The earphone device as set forth in claim 6, in which said signal-to-sound converter is connected to said sound propagation body, and is exposed to said sound propagation hole.

16. The earphone device as set forth in claim 6, in which said signal-to-sound converter is connected to said closing pad, and is exposed to said inner space of said closing pad.

17. The earphone device as set forth in claim 1, further comprising a filter provided in said sound propagation hole between said sound hole and said signal-to-sound converter.

18. A sound generating apparatus for supplying sound to a user, comprising:

a source of inside sound producing an audio signal representative of inside sound; and an earphone device radiating said sound into an acoustic meatus of a user, and including a signal-to-sound converter supplied with said audio signal and converting said audio signal to said inside sound, a sound propagation body connected to said signal-to-sound converter, having an inserting portion to be inserted into said acoustic meatus and formed with a sound propagation hole defined therein for propagating said inside sound from said signal-to-sound converter to said acoustic meatus and a sound hole open at one end thereof to an environment and a switching mechanism supported by said sound propagation body and changed between open state where the other end portion of said sound hole is connected to said sound propagation hole and closing state where said sound hole is closed therewith through movements thereof in a direction parallel to a centerline of said sound propagation hole or rotation about said centerline.

19. The sound generating apparatus as set forth in claim 18, in which said switching mechanism has a closing pad, and said closing pad and said sound propagation body are relatively rotated so that said closing pad and said sound propagation body are changed between a position where said sound hole is closed and another position where said sound hole is connected to said sound propagation hole through the relative rotation.

20. The sound generating apparatus as set forth in claim 18, in which said switching mechanism has a closing pad, and said closing pad and said sound propagation body are relatively moved in a direction parallel to said centerline said closing pad and said sound propagation body are changed between a position where said sound hole is closed and another position where said sound hole is connected to said sound propagation hole through the relative movements in said direction parallel to said centerline.

* * * * *